US010098431B2

(12) United States Patent
Davis et al.

(10) Patent No.: US 10,098,431 B2
(45) Date of Patent: Oct. 16, 2018

(54) FRAMES FOR LUGGAGE ITEMS

(71) Applicant: Eagle Creek, Carlsbad, CA (US)

(72) Inventors: Mark Davis, Carlsbad, CA (US); Rabe Chad, Round Rock, TX (US)

(73) Assignee: Eagle Creek, Carlsbad, CA (US)

( * ) Notice: Subject to any disclaimer, the term of this patent is extended or adjusted under 35 U.S.C. 154(b) by 122 days.

(21) Appl. No.: 15/024,830

(22) PCT Filed: Sep. 22, 2014

(86) PCT No.: PCT/US2014/056812
§ 371 (c)(1),
(2) Date: Mar. 24, 2016

(87) PCT Pub. No.: WO2015/047956
PCT Pub. Date: Apr. 2, 2015

(65) Prior Publication Data

US 2016/0235173 A1 Aug. 18, 2016

Related U.S. Application Data

(60) Provisional application No. 61/882,463, filed on Sep. 25, 2013.

(51) Int. Cl.
*A45C 5/14* (2006.01)
*A45C 13/04* (2006.01)
(Continued)

(52) U.S. Cl.
CPC ..... *A45C 13/04* (2013.01); *A45C 5/03* (2013.01); *A45C 5/14* (2013.01); *A45C 7/0036* (2013.01);
(Continued)

(58) Field of Classification Search
CPC ..... A45C 5/14; A45C 13/262; A45C 5/146; A45C 13/385; A45C 3/004
(Continued)

(56) References Cited

U.S. PATENT DOCUMENTS 3,443,671 A 5/1969 Dyke
3,754,771 A * 8/1973 Shagoury ..... B65B 67/1205 248/98
(Continued)

FOREIGN PATENT DOCUMENTS

FR 2874796 9/2004
WO 2007067574 A2 6/2007

OTHER PUBLICATIONS

In't Search Authority/US, International Search Report and Written Opinion dated Mar. 13, 2015, pp. 28.
(Continued)

*Primary Examiner* — Fenn C Mathew
*Assistant Examiner* — Cynthia Collado
(74) *Attorney, Agent, or Firm* — Ganz Pollard, LLC

(57) ABSTRACT

An item of luggage consisting of a plurality of sides sufficient to define a first volumetric space is coupled to a frame. The frame is movable from a first position that supports or reinforces the item to a second position that clears the frame from a surface of the item, allowing access to compartments or features on the item that were impeded by the frame in its first position. In certain embodiments, a pivotable frame is coupled to the item at opposing pivot points on the item. The frame includes a pair of arms, each arm pivotably coupled to the item at a pivot point and extending therefrom. A cross member is disposed between and coupled to the arms. The arms pivotably move the cross member from a first position to a second position. In other embodiments, a modular assembly for a frame allows for compact storage of the frame. A luggage item may also be a modular item in an assembly with a permanent frame or a modular frame.

16 Claims, 31 Drawing Sheets

(51) Int. Cl.

| | |
|---|---|
| ***A45C 7/00*** | (2006.01) |
| ***A45F 3/08*** | (2006.01) |
| ***A45C 5/03*** | (2006.01) |
| ***A45C 13/00*** | (2006.01) |

(52) U.S. Cl.
CPC ..... *A45C 7/0045* (2013.01); *A45C 13/005* (2013.01); *A45F 3/08* (2013.01)

(58) Field of Classification Search
USPC ..... 190/18 A, 18 R; 280/30, 37, 47.26, 280/47.28, 47.29, 641, 646, 647, 651, 280/654, 655, 87.041; D34/23, 24, 26
See application file for complete search history.

(56) References Cited

U.S. PATENT DOCUMENTS

| | | | | | |
|---|---|---|---|---|---|
| 3,804,432 | A * | 4/1974 | Lehrman | B62B 1/12 | 280/47.19 |
| 3,892,429 | A * | 7/1975 | dit Dalmy | B62B 1/125 | 280/651 |
| 4,040,642 | A * | 8/1977 | David | B62B 1/125 | 280/654 |
| 4,081,061 | A | 3/1978 | Tucker | | |
| 4,153,146 | A | 5/1979 | Patton et al. | | |
| 4,222,585 | A * | 9/1980 | Crothers | B62B 1/147 | 280/47.26 |
| 4,248,453 | A * | 2/1981 | Stark | B62B 1/125 | 16/18 R |
| 4,343,487 | A * | 8/1982 | Crothers | B62B 1/147 | 280/47.26 |
| 4,355,818 | A * | 10/1982 | Watts | B62B 1/12 | 280/47.19 |
| 4,437,549 | A | 5/1984 | Gibbs | | |
| 4,763,763 | A | 8/1988 | Sadow | | |
| 4,979,598 | A | 12/1990 | Verheij et al. | | |
| 5,240,106 | A | 8/1993 | Plath | | |
| 5,307,908 | A | 5/1994 | Shyr et al. | | |
| 5,358,082 | A | 10/1994 | Armstrong | | |
| 5,413,199 | A | 5/1995 | Clement | | |
| 5,427,453 | A | 6/1995 | Cloessner | | |
| 5,547,052 | A | 8/1996 | Latshaw | | |
| 5,678,666 | A | 10/1997 | Shyr et al. | | |
| 5,749,503 | A | 5/1998 | Wulf et al. | | |
| 5,875,876 | A | 3/1999 | Wang | | |
| 6,213,267 | B1 | 4/2001 | Miller | | |
| 6,382,376 | B1 | 5/2002 | Rosen et al. | | |
| 6,467,594 | B1 | 10/2002 | Wu | | |
| 6,550,651 | B1 | 4/2003 | Murdoch et al. | | |
| 7,594,569 | B2 | 9/2009 | Bass et al. | | |
| 7,641,030 | B2 * | 1/2010 | Selvi | A45C 5/03 | 190/103 |
| 7,641,032 | B2 | 1/2010 | Selvi | | |
| 7,665,642 | B2 | 2/2010 | Abbate | | |
| 8,764,045 | B1 * | 7/2014 | Kossowsky | B62B 3/027 | 280/47.18 |
| 9,233,700 | B1 * | 1/2016 | Elden | B62B 1/12 | |
| 2004/0238303 | A1 | 12/2004 | Hafif | | |
| 2005/0156002 | A1 * | 7/2005 | Neal | A45C 5/14 | 224/485 |
| 2013/0140120 | A1 | 6/2013 | Rasmussen | | |
| 2014/0202897 | A1 * | 7/2014 | Collins | A45C 3/001 | 206/315.1 |

OTHER PUBLICATIONS

Int'l Bureau of WIPO, International Preliminary Report on Patentability dated Apr. 7, 2016, pp. 11.

* cited by examiner

FRAMES FOR LUGGAGE ITEMS

RELATED APPLICATIONS

This application claims the benefit of and priority to U.S. Provisional Application Ser. No. 61/882,463, filed Sep. 25, 2013 the contents of which are hereby incorporated by reference as if recited in full herein for all purposes.

BACKGROUND

The inventive subject matter is generally directed to items of luggage, such as suitcases, backpacks, travel packs, carry-ons, duffel bags, brief cases, travel cases, and gear bags. More particularly, the inventive subject matter is directed to an item of luggage that is coupled to a structural frame that supports the item in an upright position or reinforces the item, the frame being movable between first and second positions.

Prior art luggage systems may be prone to tipping over or in need of better support from tip-over when placed in a desired upright position. Often wheel assemblies or ground-engaging braces are permanently attached to the lower portions of luggage items to help provide mobility and support. Among the factors driving changes in the way people pack and travel are airline restrictions on number, size and weight of checked and carry-on luggage. Modern luggage systems need to be more flexible and allow travelers to change the number of bags they have based on modularity and expandability. However, given the fixed nature of the mobility and support features in existing luggage systems, such systems do not provide adequate support or other functionalities from one configuration of modularity or expandability to another. For example, the use of fixed wheels on the front of a main luggage item does not lend to making the front of the main item a modular removable item because the detachment of the removable item with wheels would takes mobility away from the main item. Similarly, the brace used at the front of some luggage items to support the item upright may consist of or be connected to structure that impedes the detachment of a removable item.

Given the evolving nature of the needs of travelers and other users, and in luggage systems, there is a need for improved luggage systems.

SUMMARY

In certain embodiments, the inventive subject matter is directed to an item of luggage consisting of a plurality of sides sufficient to define a first volumetric space is coupled to a frame. The frame is movable from a first position that supports or reinforces the item to a second position that clears the frame from a surface of the item, allowing access to compartments or features on the item that were impeded by the frame in its first position.

In certain embodiments, a pivotable frame is coupled to the item at opposing pivot points on the item. The frame includes a pair of arms, each arm pivotably coupled to the item at a pivot point and extending therefrom. A cross member is disposed between and coupled to the arms. The arms pivotably move the cross member from a first position to a second position.

In other embodiments, a modular assembly for a frame allows for compact storage of the frame. A luggage item may also be a modular item in an assembly with a permanent frame or a modular frame.

These and other embodiments are described in more detail in the following detailed descriptions and the Figures.

The foregoing is not intended to be an exhaustive list of embodiments and features of the inventive subject matter. Persons skilled in the art are capable of appreciating other embodiments and features from the following detailed description in conjunction with the drawings.

The following is a description of various inventive lines under the inventive subject matter. The appended claims, as originally filed in this document, or as subsequently amended, are hereby incorporated into this Summary section as if written directly in.

BRIEF DESCRIPTION OF THE DRAWINGS

The accompanying Figures show representative embodiments according to the inventive subject matter, unless noted as showing prior art. The embodiments shown are for illustrative purposes and not necessarily to scale.

DETAILED DESCRIPTION

Figure 1:
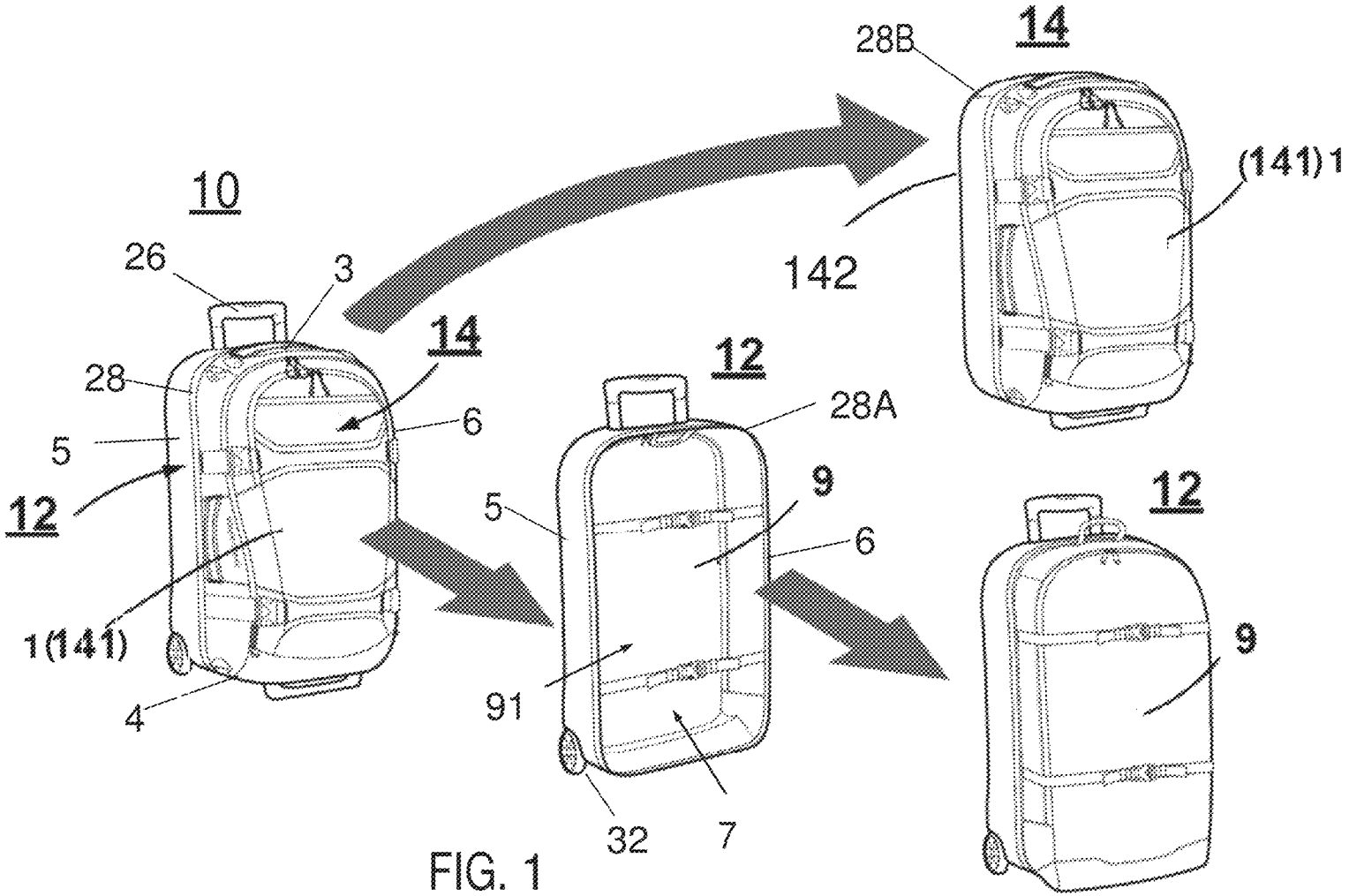
FIG. 1 shows front, left perspective views of a modular assembly of a main luggage item and a removable item coupled to the main luggage item, with the top arrow pointing to the removable item after being decoupled from the main item and the lower arrows indicating possible configurations of the main item following the decoupling of the main item.
Figure 4:
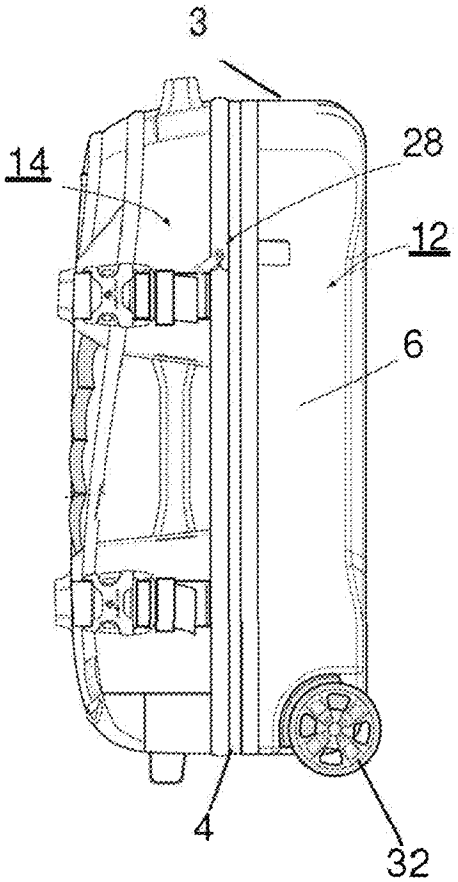
FIG. 4 shows a right side view of the general assembly of FIG. 1.
Figure 3:
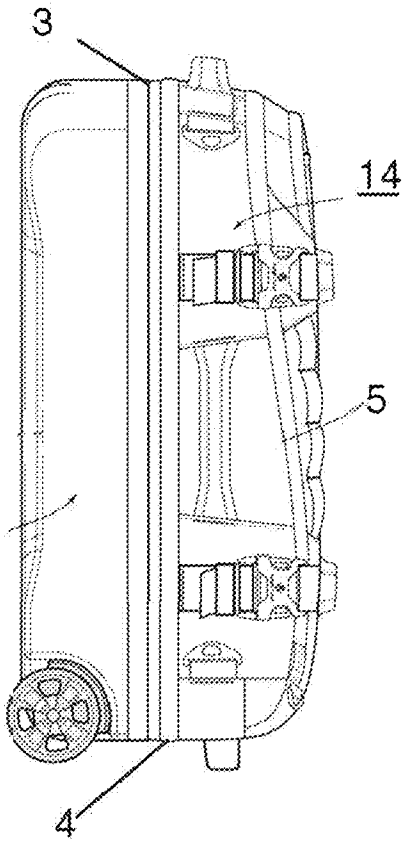
FIG. 3 shows a left side view of the general assembly of FIG. 1.
Figure 2:
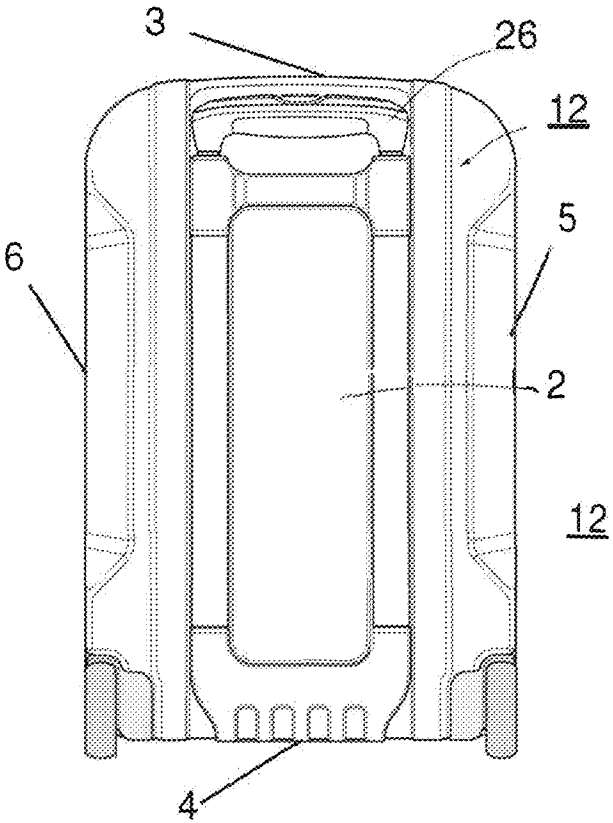
FIG. 2 shows a back side view of the general assembly of FIG. 1.
Figure 6:
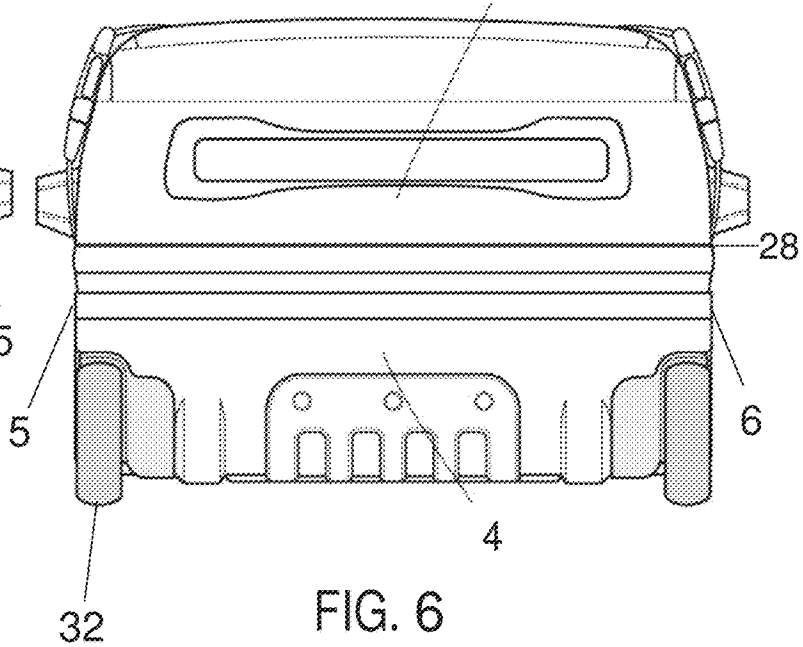
FIG. 6 shows a bottom view of the general assembly of FIG. 1.
Figure 5:
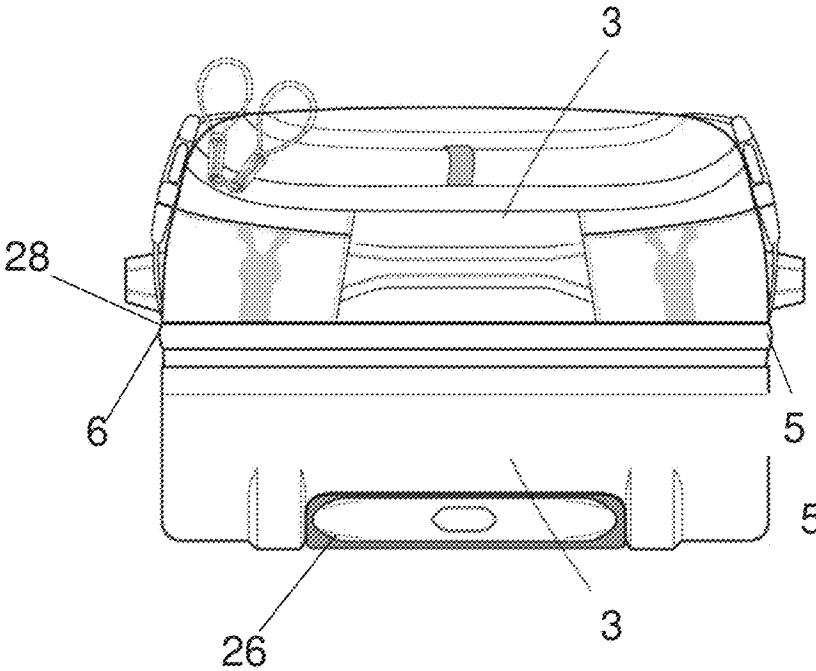
FIG. 5 shows a top view of the general assembly of FIG. 1.

Certain embodiments according to the inventive subject matter are shown in FIGS. 1-25C (the "Figures"), wherein the same or generally similar features share common reference numerals.

FIG. 1 shows front, left perspective views of a modular assembly of a main luggage item 12 and a removable item 14 coupled to the main luggage item, with the top arrow pointing to the removable item after being decoupled from the main item and the lower arrows indicating possible configurations of the main item following the decoupling of the main item. The lower arrow on the left shows the main item before the deployment of an expandable side 9. The lower arrow to the right shows the main luggage item after the deployment of the expandable section to define a volumetric configuration that is greater than the pre-deployment configuration indicated by the lower left arrow.

Figure 11B:
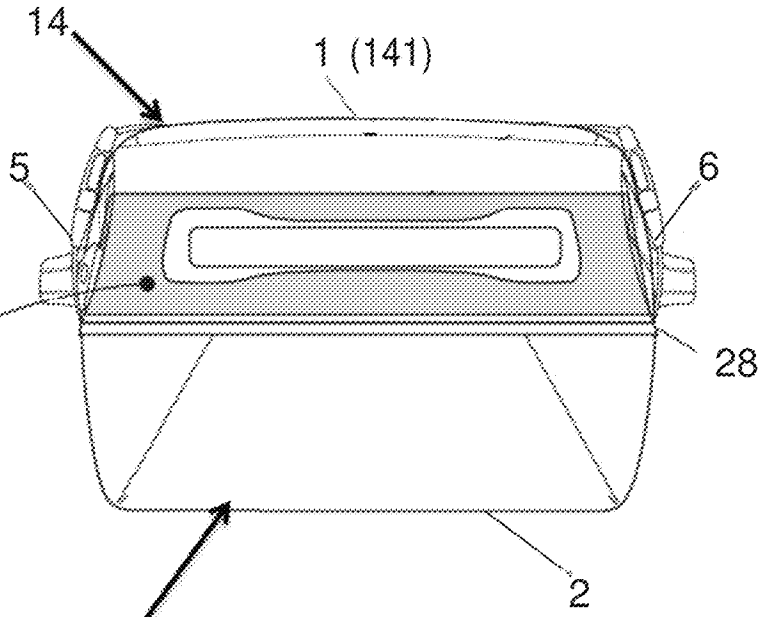
FIG. 11B shows a bottom view of the general main luggage item according to FIGS. 7A-7B, with the deployed expandable section.
Figure 11A:
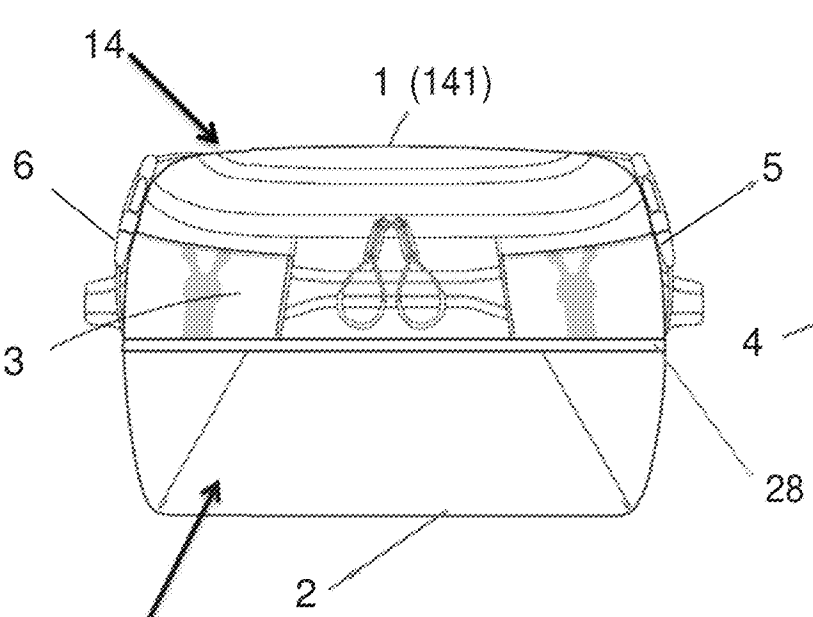
FIG. 11A shows a top view of the general main luggage item according to FIGS. 7A-7B, with the deployed expandable section.

The assembly 10 of luggage items provides an overall item that has a front side 1 and an opposing back side 2. The front and back sides are generally planar and they provide generally planar opposing boundaries that define an overall volumetric space for the interior compartment for the overall luggage item 10 and any intermediate subcompartments. In this example, the removable pack 14 provides the front side 1 of the overall (combined) luggage item 10. Referring to FIGS. 11A and 11B, the front side 1 of luggage item 10 has a front surface 141, which is the front surface of removable pack 14 and a back surface 2, which happens to be the back side of main luggage item 12. The back surface 142 of the removable pack faces the interior compartment 7 of the main luggage item 12. In some embodiments, the removable pack is designed to recede wholly or partially into compartment 7. In other embodiments, back surface 142 of the removable pack defines a generally planar boundary surface for the compartment. In yet other embodiments, back surface 142 may be concave so that it extends above compartment 7 adding to the volumetric space of that compartment. The front surface 141 of the pack is the front, exterior surface for the overall (combined) luggage item 10.

The overall luggage item 10 also has a top side 3, bottom side 4, left side 5 and right side 6, as well as front and back sides. In the example shown, each pair of front/back sides, top/bottom sides, and right/left sides are opposing sides. Each side has an exterior surface and an interior surface. The sides are the composite of the merged sides of main luggage item 12 and removable pack 14. (These same reference numerals also indicate the various sides of main luggage item 12 when the removable pack 14 is detached.) In some cases, the space between the exterior facing surface and the interior facing surface may be occupied with one or more plies of material and/or one or more sub-compartments or pockets, for example.

Luggage items, 10, 12 and 14 are not limited to having six sides; any one can have more or less sides. The overall luggage item 10 or any other item can also be in different shapes, not just rectilinear. For example, any item could be round like a hatbox or it could be pear shaped. FIG. 15 shows an example of a generally cylindrically shaped assembly 110 of a main luggage item 112 and removable item 114. Nor must any given side for an item be fully solid. For example, the top side could be left open-sided, or it could be partially sided, with an open-mesh material or a set of straps, for instance, extending across the space of the side.

As can be appreciated, a volumetric space can be defined by as few as two or more sides, and other boundaries for the volumetric space extrapolated from the two or more known sides. For instance, referring to the embodiment shown in the Figures, the general volumetric space for the interior compartment 7 of main luggage item 12 may be defined by looking at a combination of any two sides that are orthogonal to each other. These could be the top side or bottom side and any one of the right side or left side, for example. Alternatively, they could be the back side or front side and any one of the right, left, top, or bottom sides.

Figure 7B:
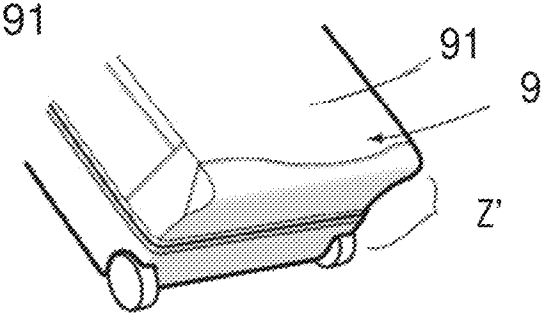
FIG. 7B is a perspective view of the bottom portion of the general main item of luggage from FIG. 7A showing the volumetric configuration of the deployed expandable section.
Figure 7A:
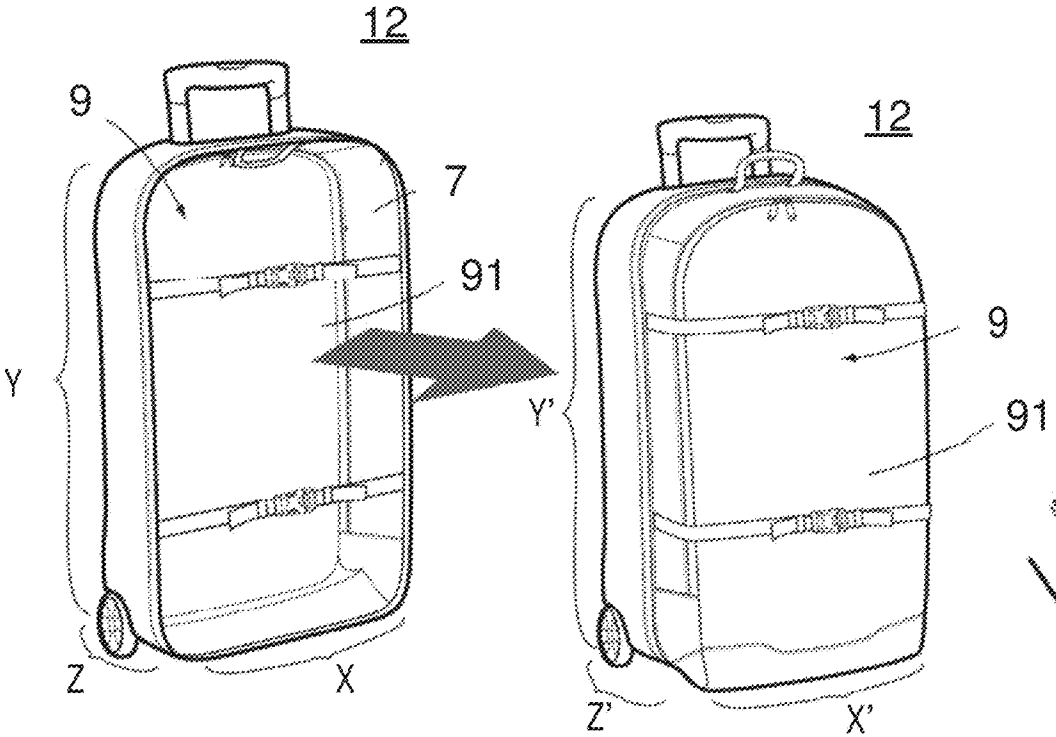
FIG. 7A shows configuration of the general main item in the assembly of FIG. 1 following decoupling from the removable item, with the arrow indicating the configuration of the main item following deployment of an expandable section stored in a compartment of the main item.
Figure 8B:
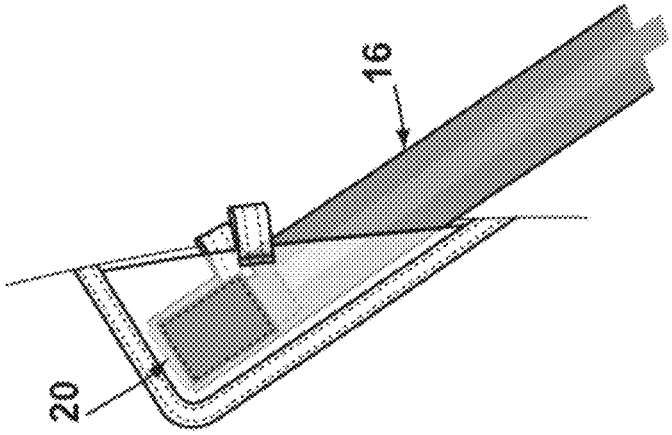
FIG. 8B shows details of a receiver associated with the general main luggage item of FIGS. 7A-7B for coupling to one end of a supporting stay, with the left side showing a removable stay decoupled from the receiver and the right side showing the stay coupled to the receiver.
Figure 8B:
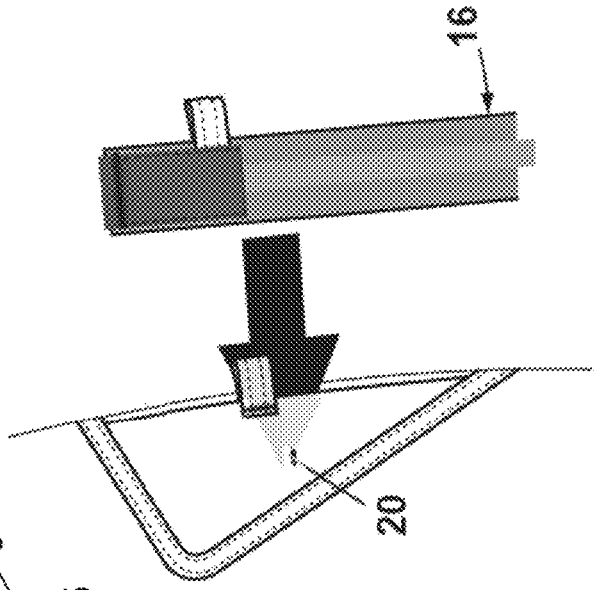
Figure 8A:
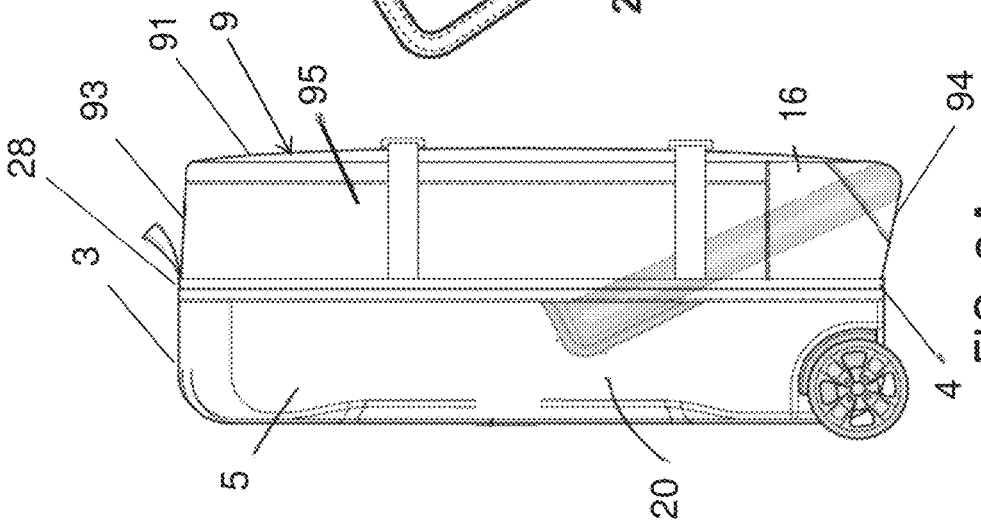
FIG. 8A shows a left side view of the general main luggage item of FIGS. 7A-7B with an optional supporting stay system associated with the main item and its expandable section, the stay being used to support the expanded section in a desired configuration.
Figure 8C:
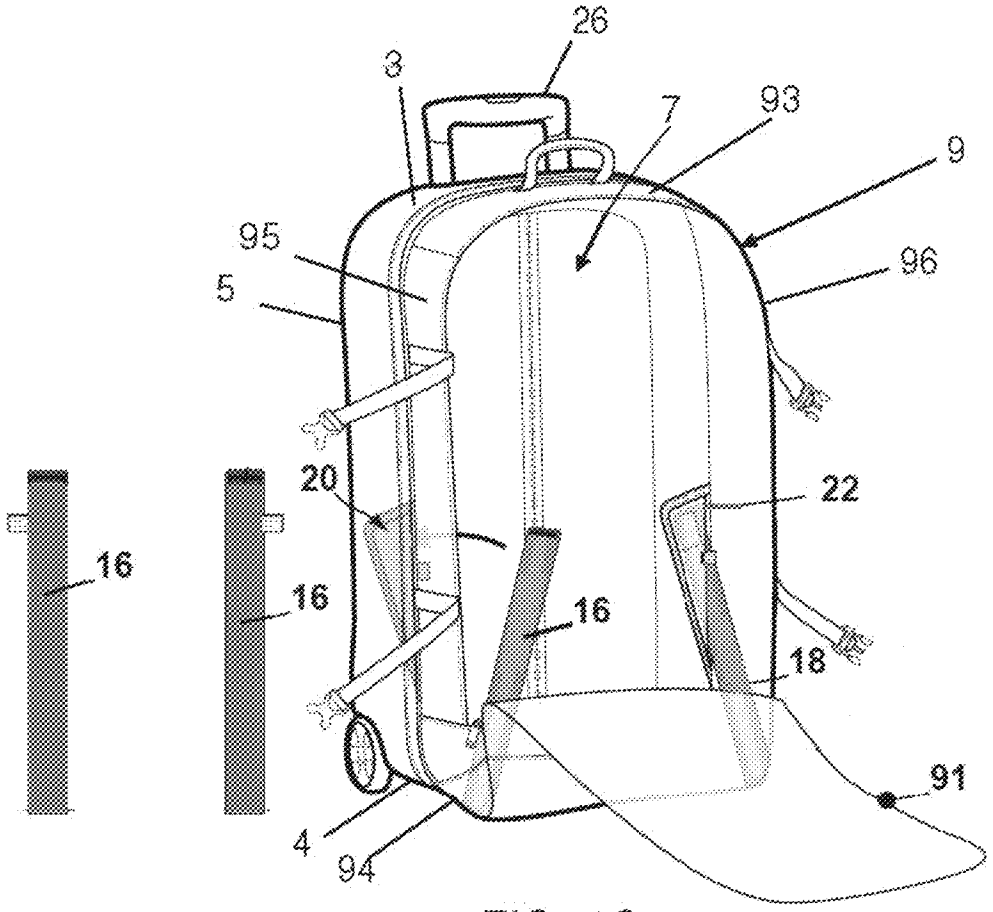
FIG. 8C shows further details of a stay system according to FIGS. 8A-8B.

Looking at FIGS. 7A-7C, the compartment or volumetric space 7 for the main luggage item 12 has dimensions, generally indicated by the brackets of X (width), Y (height) and Z (depth), which also indicate the X, Y and Z axes for the item. The dimensions define the shape and volume of space for the storage compartment 7 for the main luggage item 12. When the removable pack 14 is removed, the expandable section 9 can be deployed from its first, stowed configuration within the interior of the compartment to a second deployed configuration that increases the Z dimension to a different dimension, Z', which may be greater or smaller than Z. In the embodiment shown Z' is greater than Z. Hence, the volume of the storage compartment 7 may be increased. It may be increased to any desired amount, limited only by the space necessary to store the expandable portion within the main luggage item. Suitable increases in the volumetric space of the storage compartment could be 25%, 33%, 40%, 50%, 66%, 75%, 100%, 125%, 150%, 175%, or 200%, for example.

In other embodiments, the expandable section 9 or 91 may consist of two or more sub-compartments. The sub-compartments could be arranged in a number of ways along the X, Y and/or Z axes. For example, they could be generally parallel and coextensive to each other along the Z axis, with each capable of independently expanding along the Z axis so that there are a plurality of volumetric shapes along that axis. Similarly, there may be a plurality of sub-compartments arranged along the X and/or Z axes that allow for a plurality of volumetric shapes along one or both such axes. The compartments, sub-compartments, and pockets in the expandable section, and any other section of the luggage item 10, may have zippers, snaps, drawstrings, hook and loop closures, buttons, etc. for accessing and securely storing things.

While the example presented illustrates a combination of luggage items, in some embodiments, a single luggage item is contemplated. For example, the removable luggage item 14 could be replaced by a non-removable panel portion that has front and back surfaces defining a front side of the luggage item, with the back surface facing the interior compartment and the front surface forming an exterior surface of the front side of the luggage item.

Further, if a removable luggage item 14 is part of an overall item of luggage 10, it may be positioned not only on the front side of the main item but on any other side as well. As noted above, the removable pack may occupy some or all the volume of compartment 7. If it occupies the entire volume its compartments between surfaces 141 and 142, the overall luggage item 10 may have an overall volumetric space that is about the same as or greater than that of compartment 7. The overall volumetric space for the overall luggage item 10 can essentially be the volumetric space of compartment 7 plus the volume added by the volumetric portion of removable item 14 that extends above compartment 7, but not double counting the volume of the removable item that recedes into compartment 7. Of course, some space may be lost to the arrangement of solid materials used in constructing the removable item.

Although the expandable section 9 is disposed between back and front sides, providing expandability along a Z-axis, it may be disposed between any other set of opposing sides. For example, it may be disposed between top and bottom sides 3, 4 and expandability would be along the Y-axis. Alternatively, it may be disposed between the left and right sides 5, 6 and expandability would be along the x-axis. Still further, the assembly of luggage item 10 and the expandable section 9 may be such that the expandable section has multiple sides and the luggage item may be expandable from a first position stored in the volumetric space for an interior compartment along any one or more of the X, Y, of Z axes.

In some embodiments, the expandable section 9 or 91 is permanently fixed to the luggage item, e.g., by sewing, mechanical fasteners, or chemical bonding. In other embodiments, it may be removable by use of zippers, snaps, buttons, etc.

Among the possibilities is for the expandable section to have an expandable side, e.g., side 91, that moves from a first configuration adjacent to any of the sides of the luggage item towards an opposite side or boundary for the luggage item and thereby into a second configuration. The expandable section 9 also may have fully or partially enclosed sides 93, 94, 95, and 96 connected at the periphery of front side 91 that extend parallel to the corresponding sides 3, 4, 5 and 6 of the luggage item. Sides 93 (top), 94 (bottom), 95 (left), and 96 (right) are perpendicular to back side 2 to which the expandable side 91 is adjacent and generally parallel.

The expandable section 9 may be made of any flexible material that is suitable for use as siding for a luggage item, such as woven fibers, knit fibers or non-woven flexible materials, such as TPU films, commingled fibers, or other flexible materials. It could also be made of relative rigid materials, such as thermoformed foams, polycarbonate, ABS, PP, PE, PA, or other plastics that are mechanically expandable. For example, an expandable side 91 of expandable section 9 could be a rigid sheet material that is connected at one or more points along its periphery to an expansion system, such as an accordion structure or a telescoping structure or inflatable bladders that form or are disposed at one or more of sides 93, 94, 95, and 96. The expandable section 9 could also be constructed of a combination of flexible and relatively rigid materials.

In some embodiments, the expandable section 9 is stored in a first configuration within the compartment 7 wherein one or more sides of the expandable section are parallel to and generally coextensive with a side of the item of luggage. For example, the Figures show a side 91 of the expandable section 9 that overlies the adjacent interior surface of the back side 2 of the main luggage item. In other embodiments, an expandable side could be less than coextensive with an adjacent side of the luggage item. For example, the expandable section 9 could be rolled or folded into a more discrete space within the compartment 7 and could be deployed to a second, expanded configuration by a user or through automatic mechanisms for deployment, e.g., spring, hinge, or inflation systems.

Figure 12C:
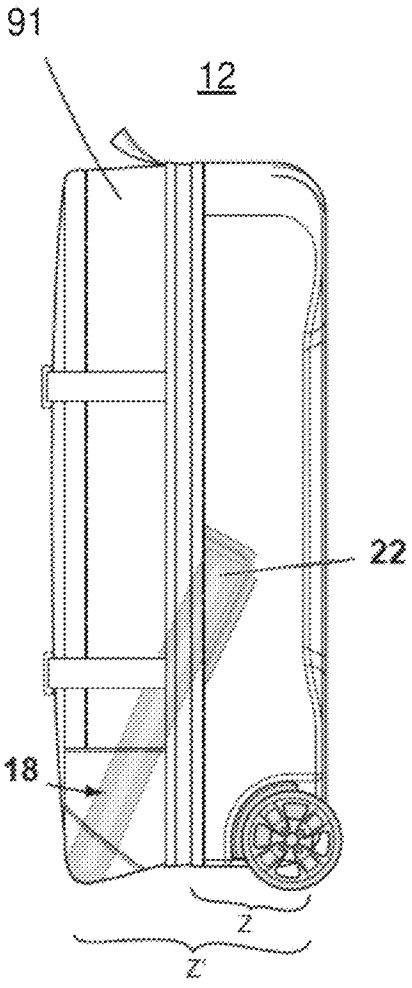
FIG. 12C shows a right side view of the general main luggage item according to FIGS. 7A-7B, with the deployed expandable section.
Figure 12B:
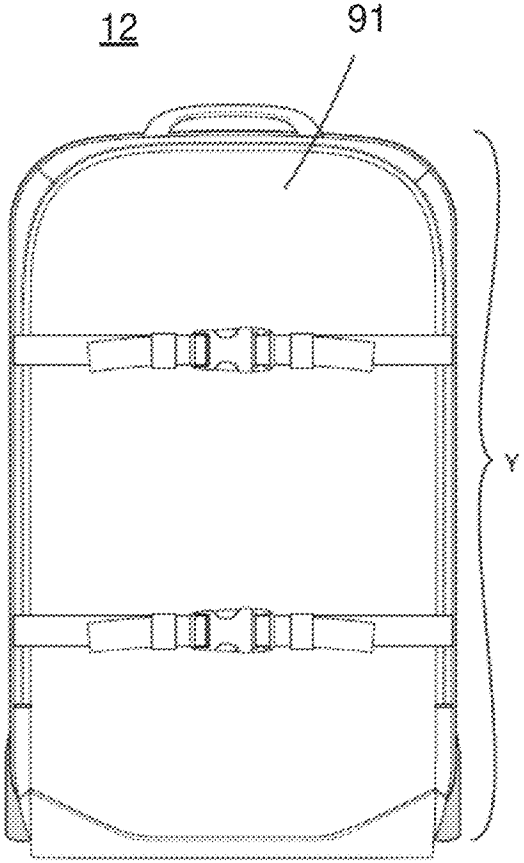
FIG. 12B shows a front side view of the general main luggage item according to FIGS. 7A-7B, with the deployed expandable section.
Figure 12A:
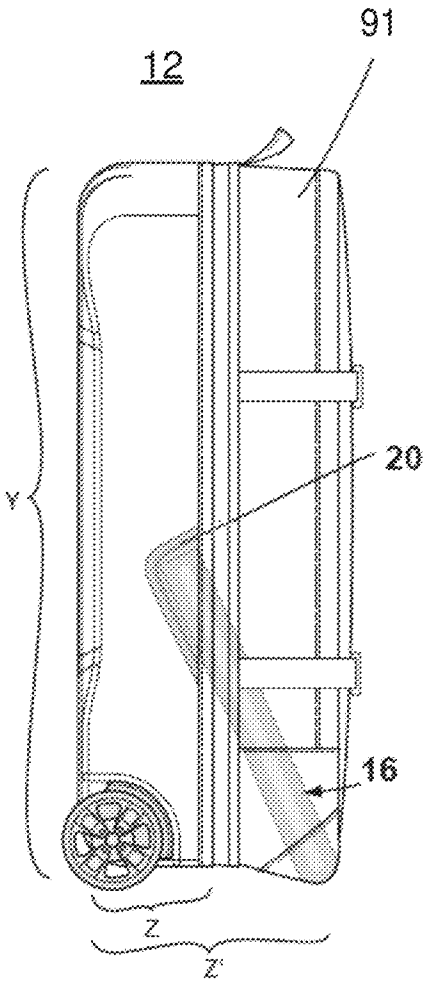
FIG. 12A shows a left side view of the general main luggage item according to FIGS. 7A-7B, with the deployed expandable section.
Figure 14B:
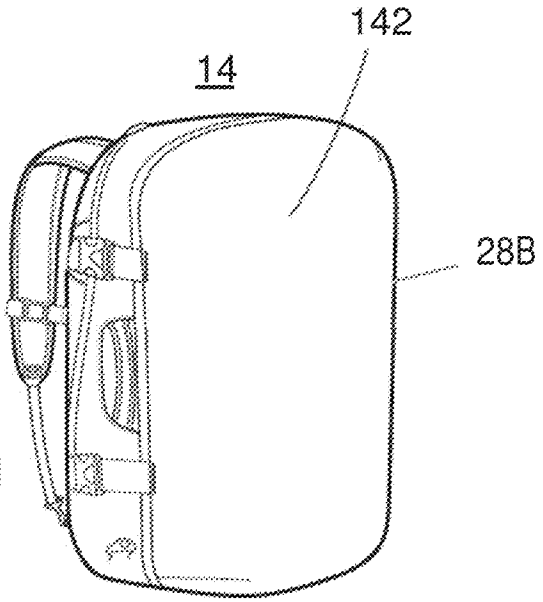
FIGS. 14A-B show the general modular assembly of luggage items of FIG. 1 with stowable shoulder straps on the removable item.
Figure 14A:
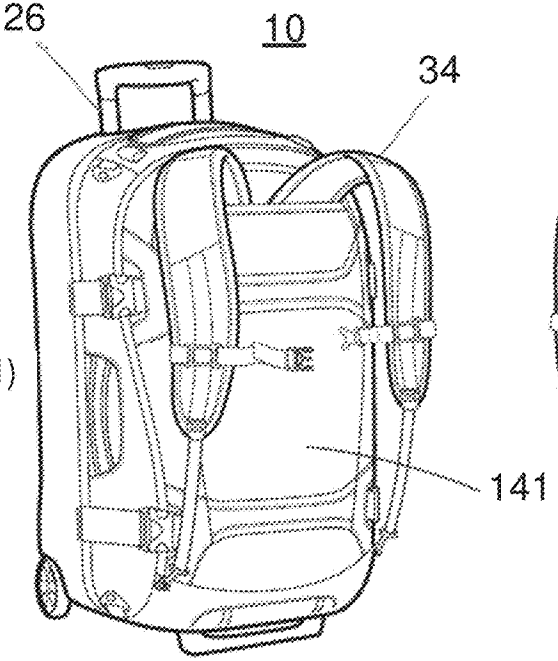
Figure 13:
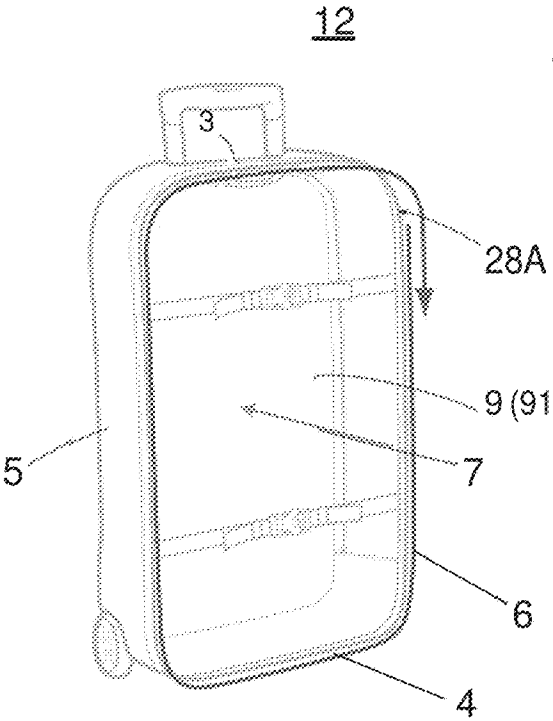
FIG. 13 shows the main luggage item with the arrow indicating a configuration for an associated coupling system for coupling the main luggage item to the removable item.

The luggage item 10 may include a stay or support system that supports some or all of the expandable section 9 in a desired form. FIGS. 8 and 12 show a pair of elongate, rigid elements 16 (left) and 18 (right), each having opposing ends. Looking at element 16 as representative, one end may be disposed in or mounted to a left side of the main item of luggage. From that end, the element angles outwardly and downwardly so that the opposite end extends beyond the boundary of the front, bottom side of the compartment 7 for the main luggage item 12. An opposite end is disposed on or mounted to or near the lower left corner of a flexible expandable section so as to tension the expandable section to the expanded Z' position (FIG. 12). The right side has a corresponding element that tensions the expandable section at its lower right corner. In the embodiment shown, a receiver, such as pockets 20, 22 on luggage item 10 are used to hold the top ends of the elements 16, 18 in place. The bottom ends may be hingeably disposed on the luggage item or placed in pockets similar to the top ends, for example. In short, the stay system extends into the second volumetric space intended for the expandable section and supports the expandable section in an intended configuration for defining the second volumetric space.

Other mechanisms that could be used to deploy expandable section 9 include other hinged structures, e.g., opposite ends of the elongate elements 16, 18 are disposed on the luggage item, and the hinge point is in between the opposing ends of the elongate elements 16, 18. Another option would be to use inflatable bladders that extend along the periphery of one or more sides of the expandable section, for example.

Figure 9:
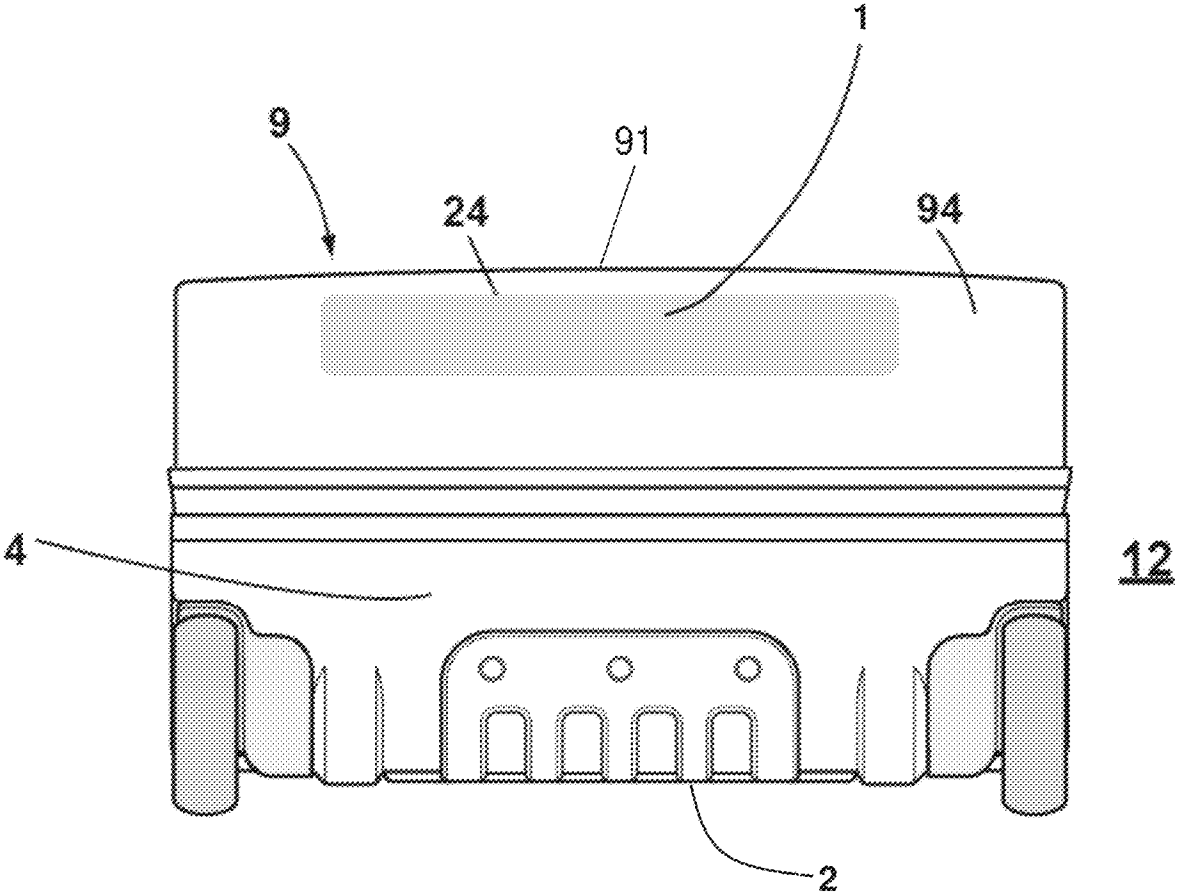
FIG. 9 shows a bottom view of the general main luggage item according to FIGS. 7A-7B with an alternative stay system associated with a bottom side of a deployed expandable section.
Figure 10:
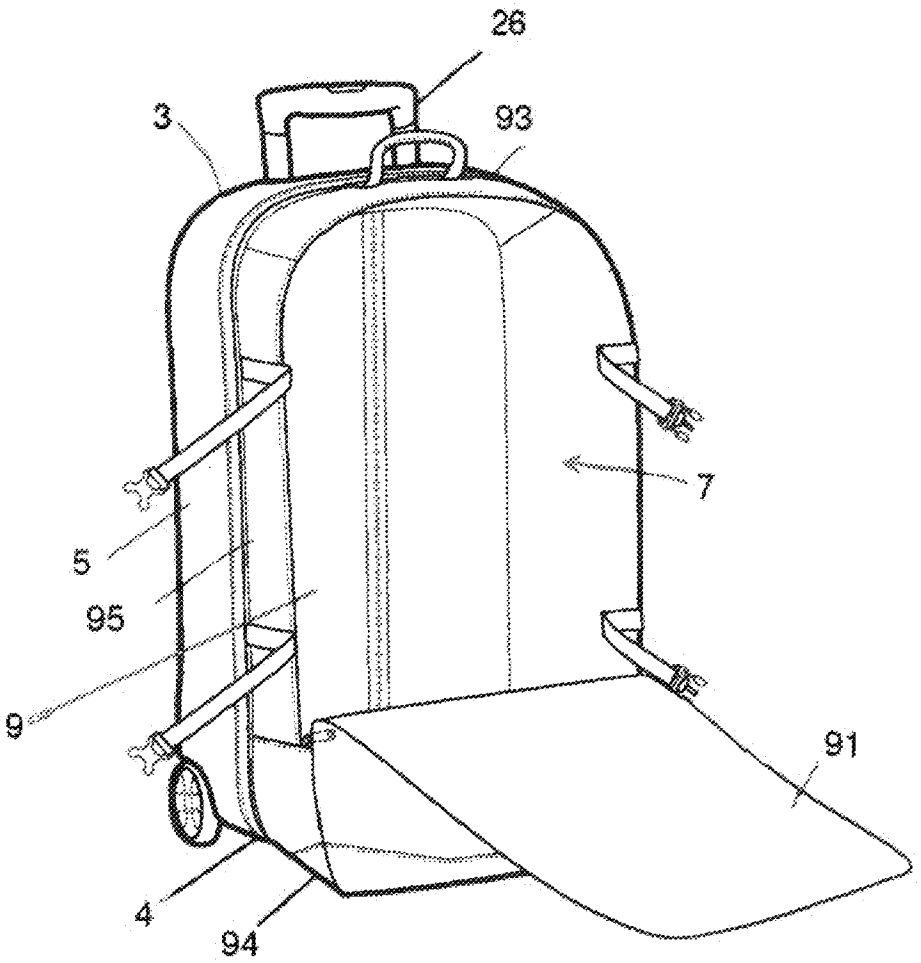
FIG. 10 shows details of an openable front side of the expandable section of the general main luggage item of FIGS. 7A-7B.

Additional stiffening or tensioning elements may be associated with the expandable section. For example, an elongate stiffening element 24 may be disposed or placed in the expandable section along the bottom section 94, between the left and right corners, as shown in FIG. 9, for example.

A luggage item according to the inventive principles may be configured with any number of other features to advance and supplement the inventive advantages. For example, as seen in the Figures, the luggage item may optionally include fixed or telescoping poles 28 with a handgrip 30 on one or more of the telescoping poles. The luggage item may include wheels 32 for rolling the item. It may include one or more shoulder straps 34 so that the luggage item may be carried as a shoulder pack or bag or as a backpack. The luggage item may include storage compartments for stowing the strap. The luggage item may include one or more handgrips on the body of the item to facilitate carrying and handling of the luggage item. The luggage item may include any number or arrangement of sub-compartments and pockets in a similar fashion as described above for the expandable section.

One or more removable luggage items may be attached to a main luggage items using zipper systems having one or more complementary zipper tapes 28 (28A, 28B) mounted along a defined area on each item. The removable items may attach to the main luggage item in other ways, such as by straps, snaps, and other inter-engaging parts.

Movable Frame for a Luggage Item

FIGS. 16 to 25C show embodiments of the inventive subject matter relating to a luggage item coupled to a frame, forming a composite assembly. The frame may assist in structurally supporting the luggage item in a desired upright position or providing a structural frame for a desired functionality associated with the item. For example, one possible functionality might be reinforcement of the walls of the item. By "reinforcement" it is meant that structure of the frame may serve to rigidify the walls of the item or provide a rigid or semi-rigid protective shield over a desired portion of the item. The frame may be permanently affixed to the item, as seen, for example, in the embodiments of FIGS. 16-18D, and 24A-D. Or it can be removably affixed to the item, as seen, for example, in the embodiments of FIGS. 19-23 and 25A-25C. The luggage item can be any of the various kinds contemplated herein, including, without limitation, suitcases, backpacks, travel packs, carry-ons, duffel bags, brief cases, travel cases, and gear bags. The items can have rigid, semi-rigid or flexible or soft sides or combinations thereof.

Figure 15A:
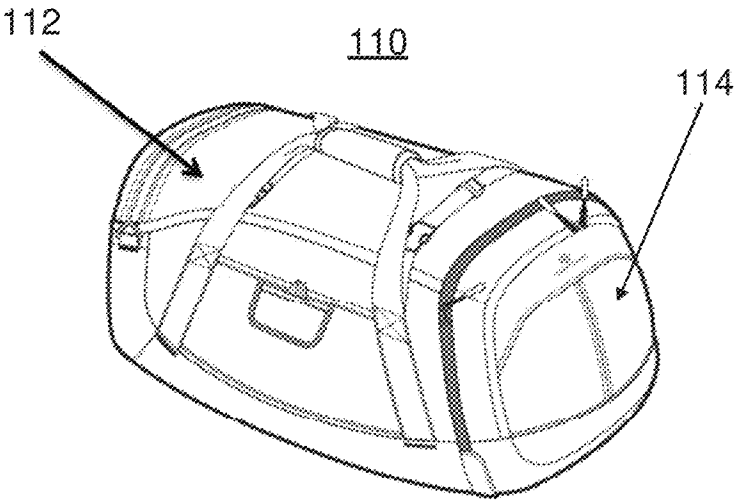
FIGS. 15A-15B show another example of an assembly of a main item of luggage in the form of a duffel bag with a removable item attached at one end, namely a shoulder bag, with FIG. 15A showing the items coupled together and FIG. 15B showing the items decoupled from one another.
Figure 15B:
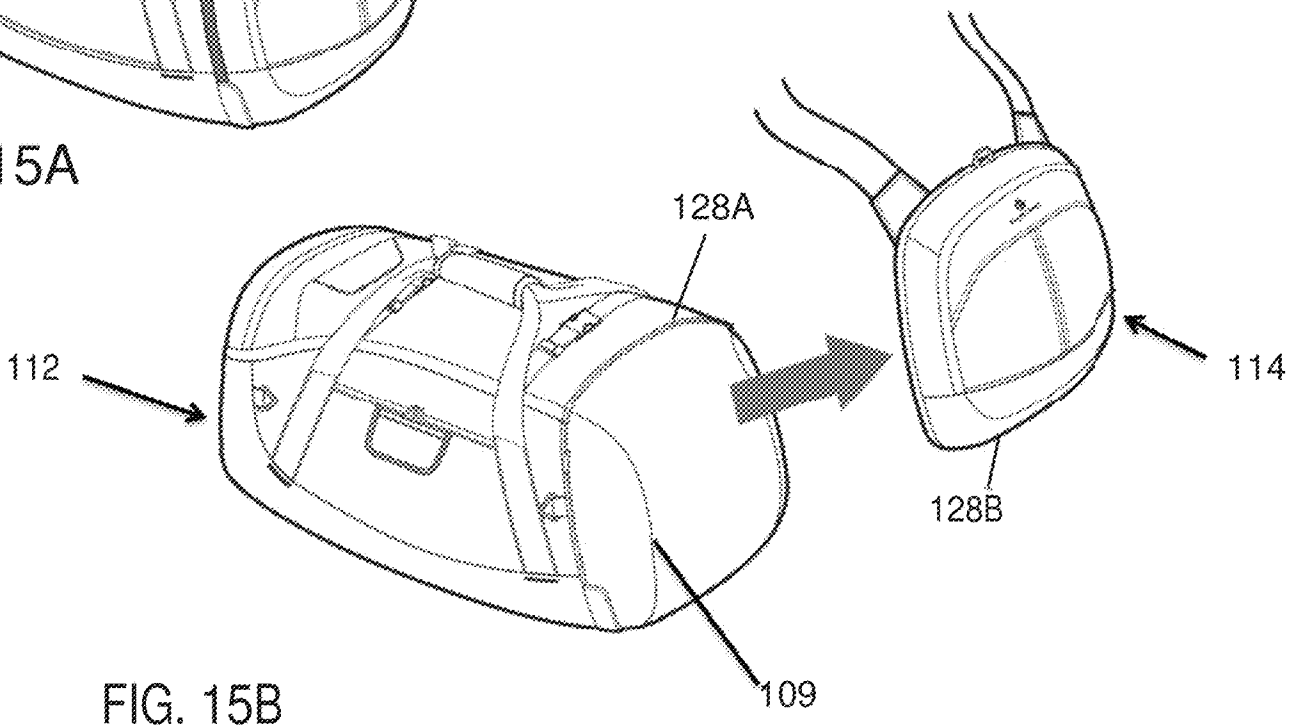

FIGS. 15A-15B show another example of a modular assembly 110 of a main item 112 of luggage in the form of a duffel bag with a removable item 114 attached at one end, namely a shoulder bag that includes a shoulder strap. The bag and main luggage items may be coupled via a zipper system 128 (128A, 128B). FIG. 15B shows an expanded section 91, which is stored in a compartment at one end of the duffel bag, in an expanded condition following removal of the shoulder bag 114.

In one possible embodiment, the luggage item has a plurality of sides, e.g., a front side 1, back side 2, top side 3, bottom side 4, left side 5, and right side 6, sufficient to define a first volumetric space. (In the case of cylindrical or other non-rectilinearly shaped items, such items may be defined in terms of similar sides based on the sides being generally parallel or orthogonal to each other.) A rigid or semi-rigid frame 30 is associated with the exterior surface of the item and is configured to move between a first position to second position to support, reinforce or otherwise structurally enhance the item. The rigidity of the frame can be selected to match a desired function.

Figure 21A:
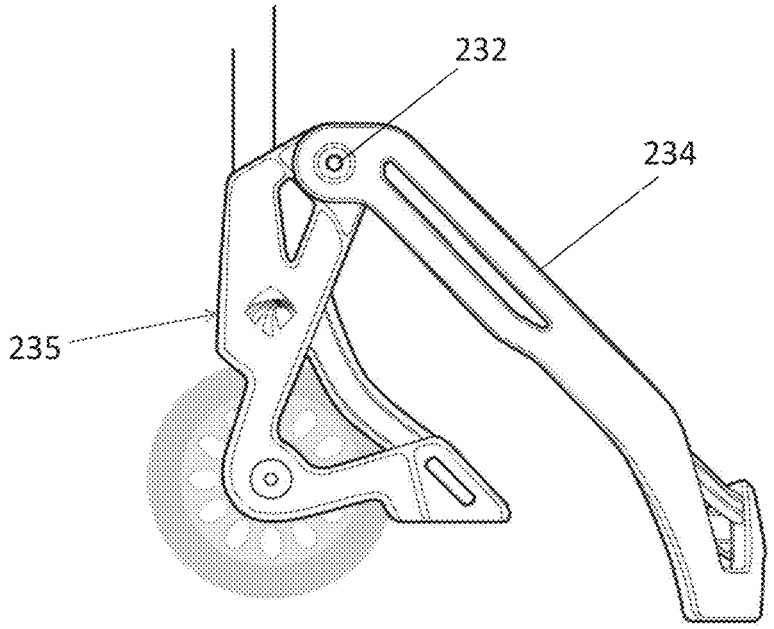
FIGS. 21A-21B show details of a wheel assembly for use with a luggage frame, the wheels being deployed in first and second positions.
Figure 21B:
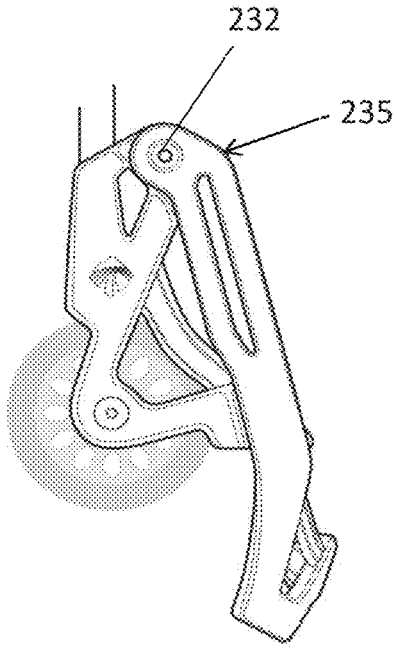
Figure 22A:
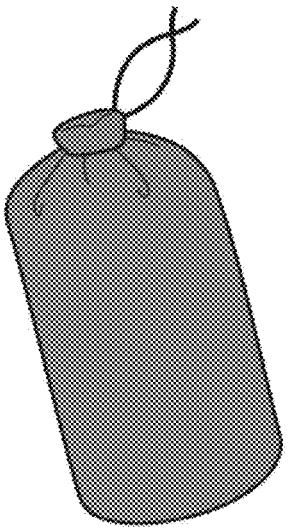
FIGS. 22A-22F show a sequence of illustrations demonstrating the packing and assembly of a modular frame and luggage item, such as shown in FIGS. 19-20.
Figure 22B:
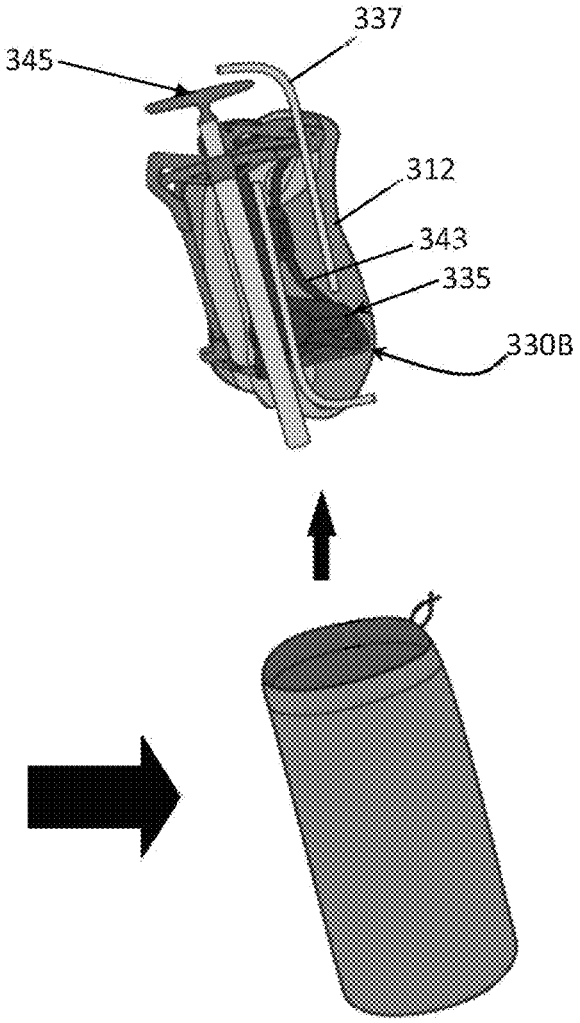
Figure 22C:
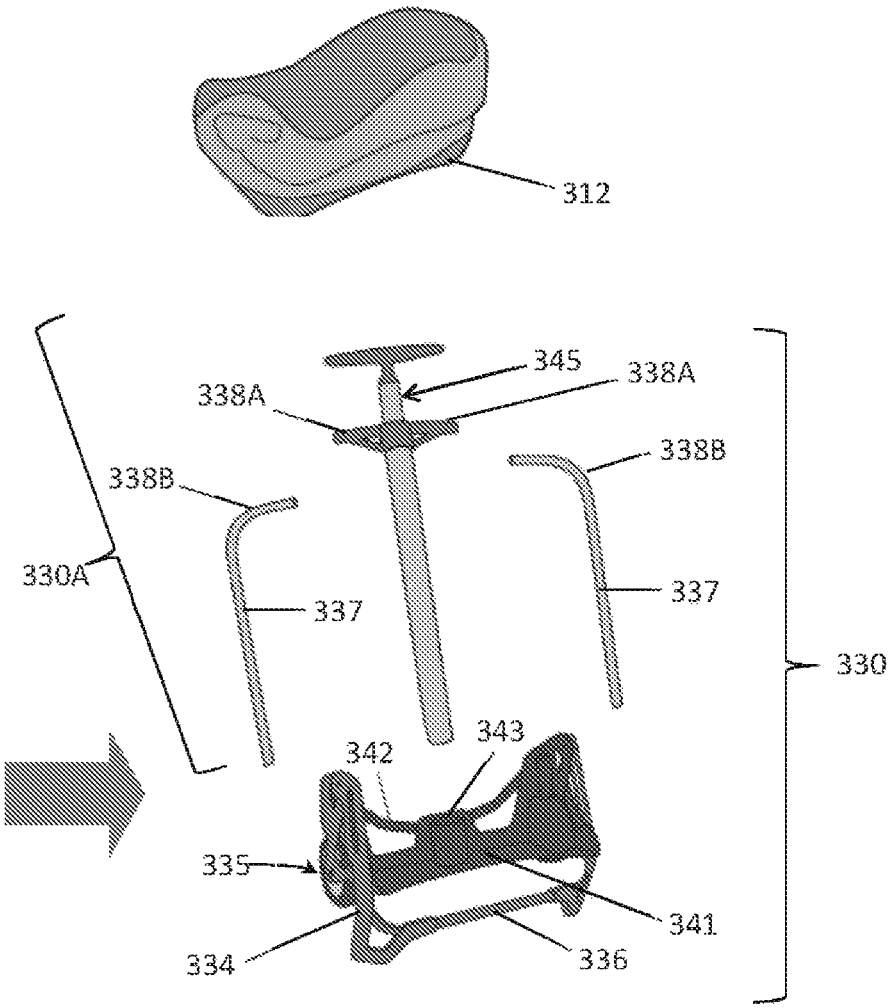
Figure 22D:
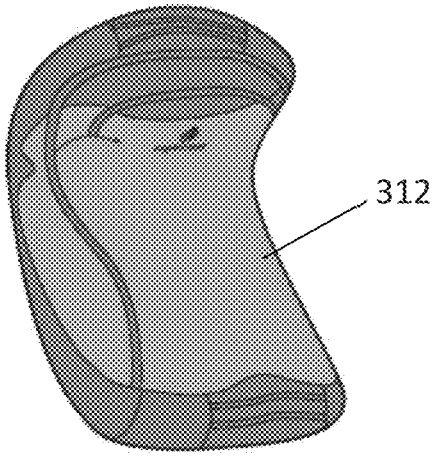
Figure 22D:
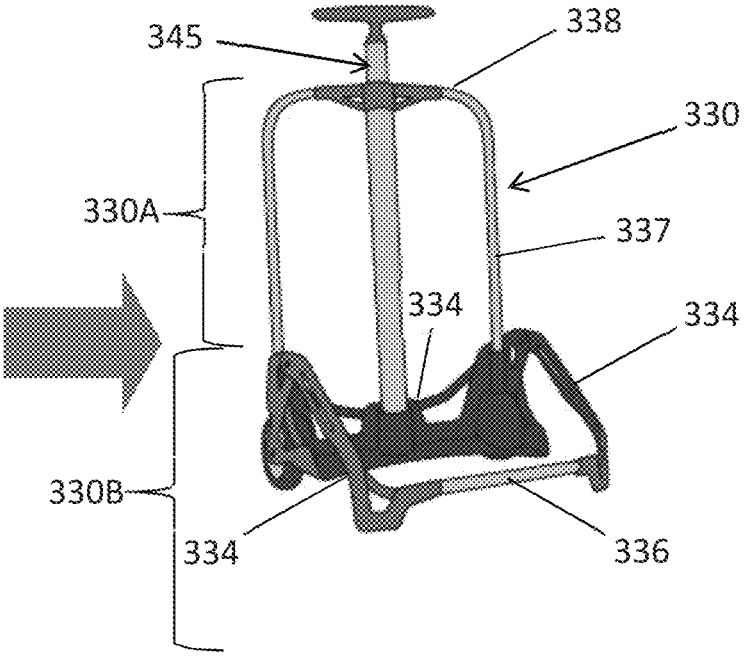
Figure 22E:
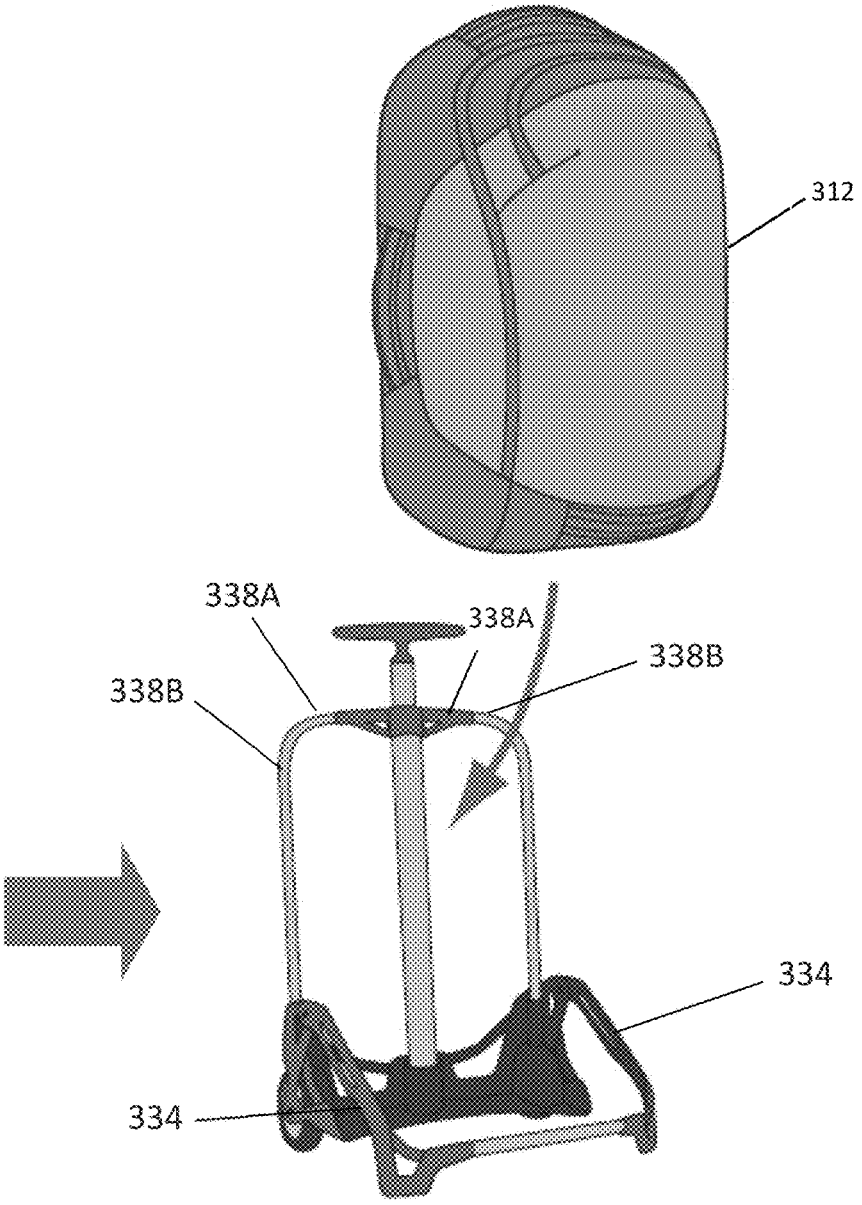
Figure 22F:
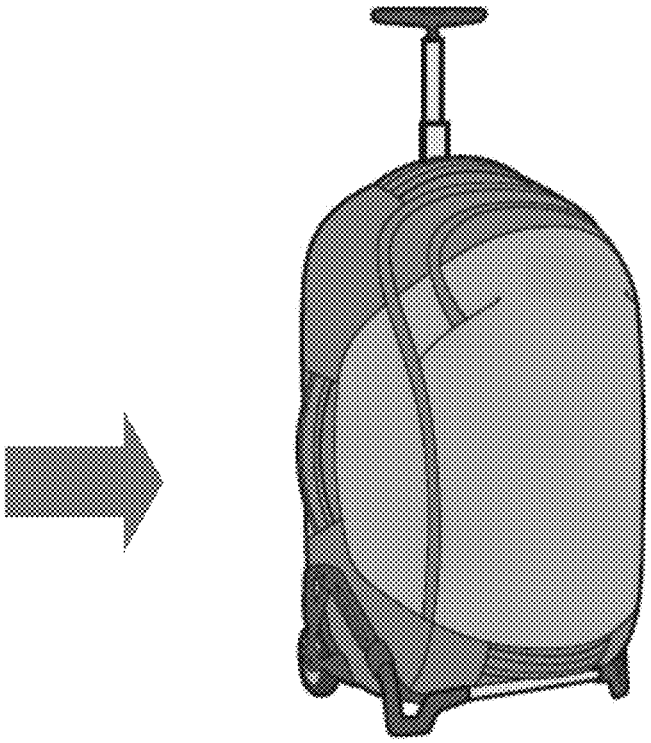

The frame 30 may be movably coupled to the item via various mechanisms to provide such functionalities. (In some Figures, the frame may be referred to as a "foot".) For example, the frame may be coupled to the item via pivot mechanisms 32, e.g., an assembly of parts that define a pivoting axis and rotatably intercouple the frame to the item. The pivot mechanism allows the frame, or components thereof, to move between the first position (FIG. 17A) and second position (FIG. 17B) by rotation around such an axis. Another possibility based on pivoting action is the frame, or components thereof, include a hinge mechanism, such as in a folding bracket (FIGS. 21A-B). Yet another possibility is for the frame or components thereof to move between first and second positions via a telescope mechanism, i.e., an assembly of telescoping parts. In still other embodiments, a swivel mechanism could be used to swing the frame, or components thereof, in and out of first and second positions. In still another example, the frame could be coupled to the item using a track system wherein male and female elements slidably engage one another, such as in a U-channel track system, or as in a hoop and rod system (e.g., like a curtain rod). As one more example, the frame could be made of an assembly of multiple components that are removably coupled via snaps, interlocks, cables, etc. For purposes of illustrating the inventive principles, the following discussion will look at an embodiment that is based on the use of a pivot mechanism that allows for the frame or components thereof to pivotably move between first and second positions.

Looking at the FIGS. 19-21B, opposing pivot points (represented by pivot mechanisms 32) are associated with the assembly 210 of luggage item 10 and frame 30. (Hereinafter, reference number 32 (232 or 332) will be used interchangeably to refer to the pivot points and pivot mechanism.) The frame includes a pair of arms 34, each arm pivotably coupled to the item at a pivot mechanism 32 and extending therefrom. In this case, the pivot points and pivot mechanisms are disposed on opposing sides of the item, namely the left and right sides 5, 6.

A cross member 36 is disposed between and coupled to the ends of the arms 34, which are opposite the ends coupled to the item at the pivot points. The arms pivotably move the cross member from a first position to a second position. Looking at the embodiments shown in the Figures, when the cross member is in the first position it is capable of engaging the ground and supporting the item 10 in an upright position, and at least a portion of the frame 30 is disposed across at least a portion of an exterior surface of the item.

In the example illustrated, the pivot points 32 for the frame 30 are disposed on opposing side walls of the item, but the position can vary. In this case, the side walls are the left and right side walls 5,6. The pivot points are disposed on the side walls at a position on the side walls that is closer to the back wall 2 than the front wall 1 and at a position on the side walls 5,6 that is closer to the bottom side 4 of the item than the top side of the item.

To provide pivotability between the item 10 and the arms 34 of the frame, the arms may be coupled via sockets in the arms and item that receive a cotter pin. The arms rotate on the cotter pin, which corresponds to a pivot axis. Other arrangements of apertures (which may be thru-holes or blind holes) on the arms and/or item that pivotably engage an axle structure on the arms and/or item may be used to provide pivotable coupling between the frame and the item. Any such components for pivotable coupling can be separate pieces from the frame and/or item or they may be unitary structures with the frame and/or item. For example sockets or other apertures may be molded into walls of the item as a unitary structure or may be formed in a separate component that is assembled to the walls of the item. As another example, rivets may be used to attach the frame to the item. The rivets could attach through a rigid wall or structure for the item. For example, the item could be formed of a polycarbonate shell portion that receives the rivets that pivotably inter-couple the arms of the frame to the item. For items that do not have a rigid structural shell, the item could include an internal structure, such as a plate or frame of aluminum tubing or honeycomb plastic that the movable frame could be riveted or otherwise pivotably or hingeably coupled to.

In alternative embodiments, the arms may be pivotably disposed on wheel assemblies for the luggage item. For example, the pivots points may be associated with wheels mounted at the bottom of the item. The frames may include apertures that pivotably engage a part of the wheel assembly such as the wheel axles.

As seen in the Figures, the frame 10, consisting of the arms 34 and cross member 36, may have a generally U-shape. The arms and cross member may be an assembly of separate pieces, forming a composite frame or they may be a unitary structure. For example, a unitary structure could be a monolithically formed piece. Monolithically formed structures can be formed by various known or to be discovered techniques, such as plastics molding, metal casting, fusion of plastic or metal parts, carved wood or other materials, three-dimensional printing, etc. Accordingly, the frame, either as a unitary structure or an assembly, may be formed of any number of materials or combinations of materials, including plastics, metals, woods, and ceramics.

A securing device 38 may be coupled to the item to lock the frame 30 in a first position or a second position, or anywhere in between such positions. For example the securing device can be straps, hook and loop fasteners, catches, latches, etc. The pivot mechanism 32 may also include a ratchet assembly that allows for setting of the frame in one or more desired positions.

Figure 16:
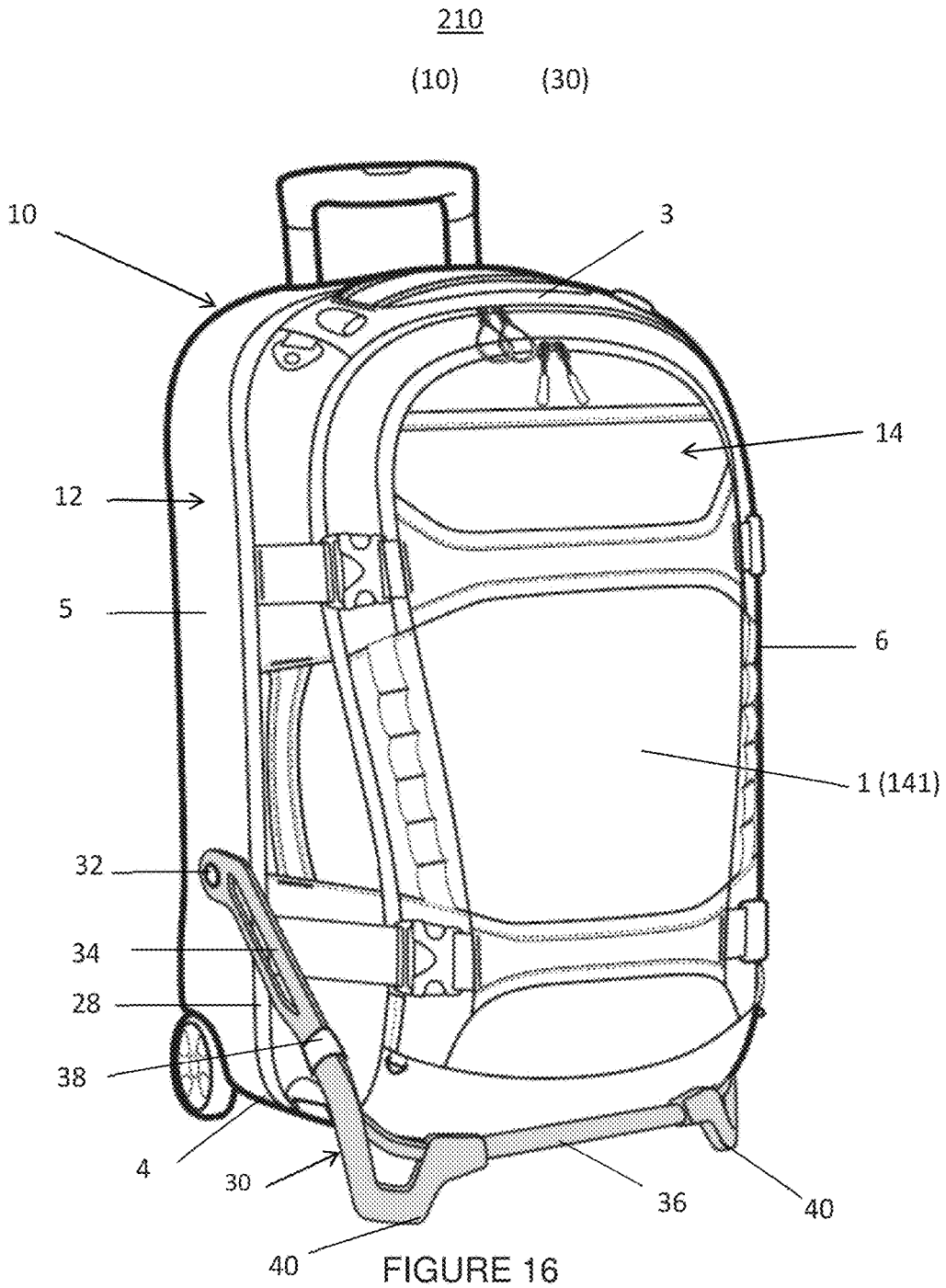
FIG. 16 shows a front left perspective view of another embodiment of a luggage item, the item having an associated movable frame.
Figure 17A:
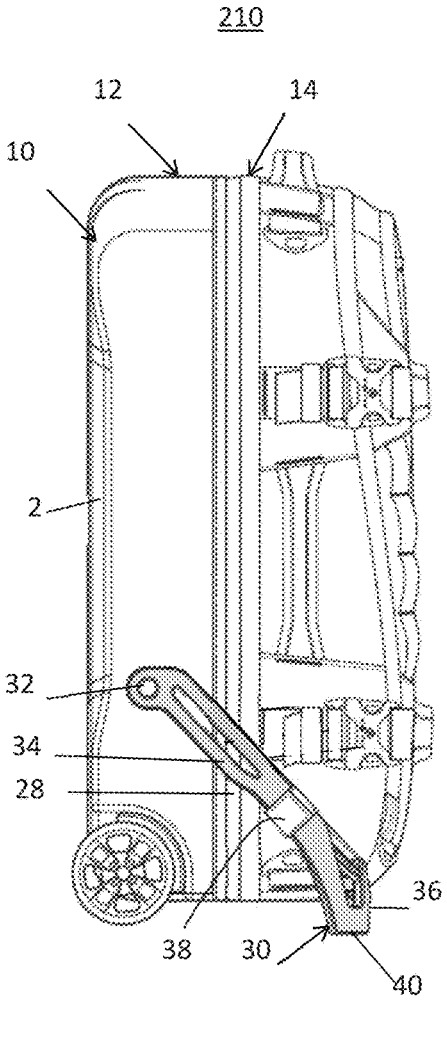
FIGS. 17A-17B show right side views of the item of FIG. 16 with the frame in first and second positions.

In the illustrated embodiments, the frame 30 is capable of engaging the ground and supporting the item in an upright position. In this example, the frame and cross member 36 of the frame engage the ground when in a first position (FIG. 17A). The arms may also be configured to engage the ground, in addition to, or instead of, the cross member. To assist in ground engagement, the frame may include one or more feet 40 disposed on the cross member and/or the arms. In this example, the cross member 36 includes feet 40 that are configured to engage the ground when the item is in an upright position and the cross member is in the first position, as seen in FIG. 16, for instance.

The frame 30 shown in the Figures is configured as a cradle such that when the cross member 36 is in the first position (FIG. 17A), the cross member and the arms 34 are closely adjacent the lateral sides 5,6 of the luggage item, and the cross member is closely adjacent a lower front edge of the luggage item. This cradle configuration allows for a compact overall design of the item and frame. "As used herein", "closely adjacent" means that at least the arms and/or cross member may be positioned to extend across and touch the surface of the item or to extend across and be within two inches from the surface.

Figure 17B:
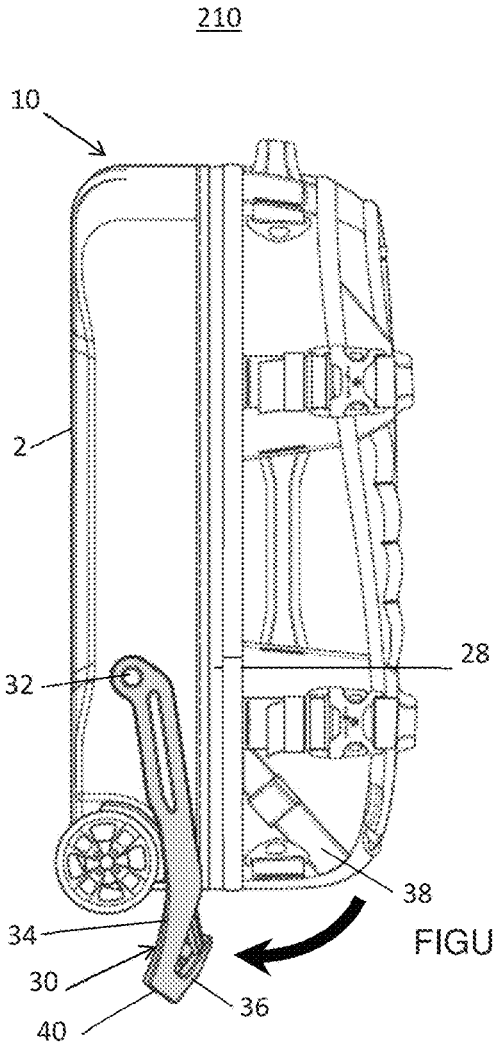

Unimpeded access to compartments or features on the item, e.g. closure mechanisms, such as zippers at zippered seam 28, may be achieved when the cross member is moved from a first position to a second position. As seen in FIG. 17B the portions of the cradle 30 disposed across the exterior surface of the luggage item, namely the left and right sides 5,6 and lower edge of the front side 1, clears the cradle from those surface so that the surfaces are unimpeded by the portions of the cradle. In the example shown, a closure mechanism, such as a zipper, for accessing a compartment in the item is associated with side wall portions of the exterior surface of the item. Movement of the cross member from the first position to the second position clears the arms of the cradle from the closure mechanism to provide unimpeded access to the closure mechanism. The movement also clears the cross member of the cradle from an openable front side of the item or a removable item that defines the front side of the item.

The frame 30 may have a range of pivotability. For example, the arms 34 may pivotably couple to the item such that there is at least 5, 10, 15, 20, 25 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, or 180 degrees of pivot backwards and/or forwards. As seen, when the frame is in the first position (FIG. 17A) for ground engagement, the arms, radiating from their pivot points, form a transverse angle relative to the left and right sides of the item. The angle is about 125 to 135 degrees from the twelve o' clock position of the pivot points. In the second position (FIG. 17B), the frame is clear of the bag surfaces and features and forms an angle of about 180 degrees from the twelve o' clock position of the pivot points 32.

The frames shown in the Figures may have generally tubular or rod-like structures for its elements such as arms 34 and cross member 36. The frame elements may be generally linear or curvilinear in form. However, the arms and/or cross member could have other configurations. For example, to provide reinforcement, the frame elements could have more planar or three-dimensional forms. The elements could be in the nature of sheets or plates to cover broader areas of the sides of the item. The elements could also have curved shapes. The inventive subject matter is not limited to use of pivots or hinges to move the frame. Accordingly, slide or swivel mechanisms could be used to facilitate movement of frame or frame components that have relatively broad surface areas. Further, the frame may have components that move independently of one another to facilitate placement of frame parts around desired areas of any item. The frame components may also include modular, detachable features, such as protective plates or sheets that are position around desired areas of an item. For example, the frame could be configured to support a clip-on solar panel for power generation. The frame may include integrated features, such as a handle, carrying straps, water bottle holder, etc.

Like other embodiments disclosed herein, the item used with a frame according to the inventive subject matter is not limited to any particular shape. For instance, the item may have a generally rectilinear shape, as in a suitcase or briefcase. Or, it may have a generally cylindrical shape, as in a duffel bag. The item may have sides that are rigid, semi-rigid and/or flexible. Also like other items disclosed herein, the item may have one or more wheels are disposed on the support to facilitate rolling of the item. The one or more wheels may be disposed in wheel assemblies on the body of the item or on the frame. For example, wheel assemblies may be disposed on the arms and/or the cross member and are configured on the item to facilitate rolling of the item.

Referring to FIGS. 19-23 and 25A-25C, in some possible embodiments, the inventive subject matter is directed to a frame, such as frames 230 or 330, that consists of an assembly of components that are coupled by one or more mechanisms that allow for collapsibility (e.g., folding or detachment) of the frame or portions thereof. For instance, each arm in a frame may consist of an assembly of components that are coupled by a mechanism that allows for collapsibility of the arm. For example, FIGS. 19-23 show a frame 230 that has arms 234 pivotably coupled to a wheel assembly 235 (335) at pivot points 232. For example, a mechanism could be a hinge enabling the arms 234 to collapse from a first position (FIG. 21A) to a second position (FIG. 21B). As another example, the mechanism could comprise a telescope mechanism, enabling the arms to collapse/expand by telescoping. Other known mechanisms for inter-coupling parts may be used.

As with other embodiments disclosed above, the luggage item may include an expandable section 9 disposed within the space between first and second opposing sides, for example, the front and back sides 1,2, wherein at the first opposing side is for a removable item and provides an exterior surface 141 for the item of luggage. (FIGS.

Figures 18A, 18B:
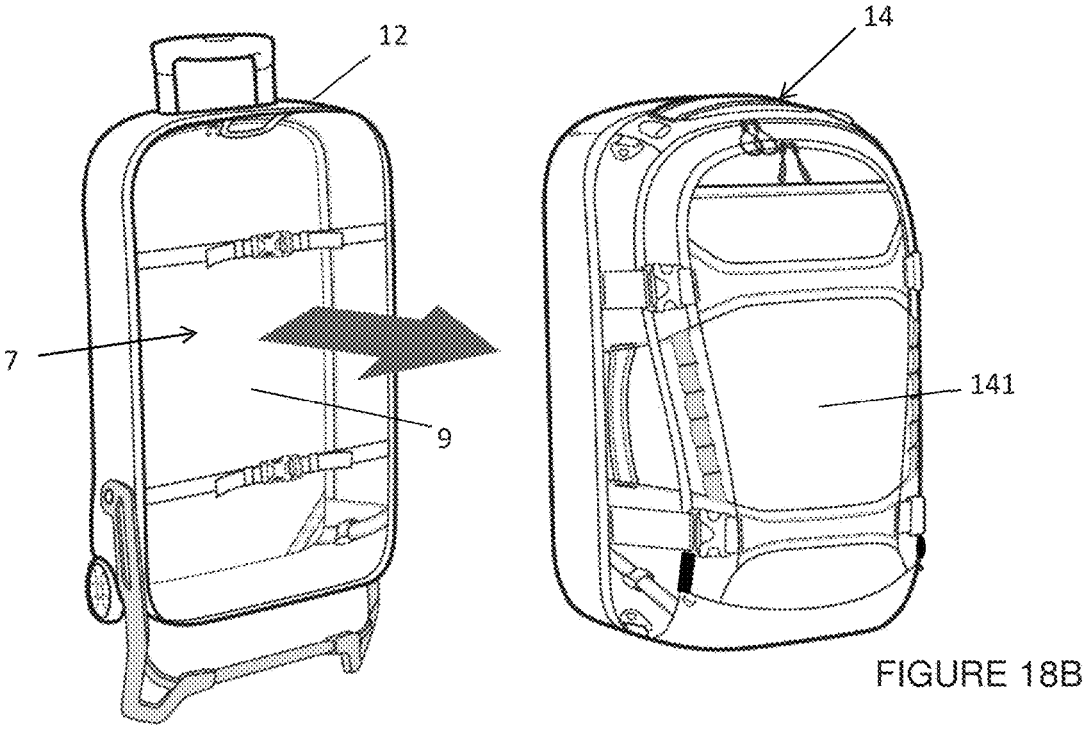
FIGS. 18A-18D show an example of a modular luggage item used with an associated movable frame, with FIG. 18A showing the main item and an expandable section in the item, FIG. 18B showing a removable luggage item couplable with the main item, and FIGS. 18C-D showing the deployment of the expandable section from the main item.
Figure 18C:
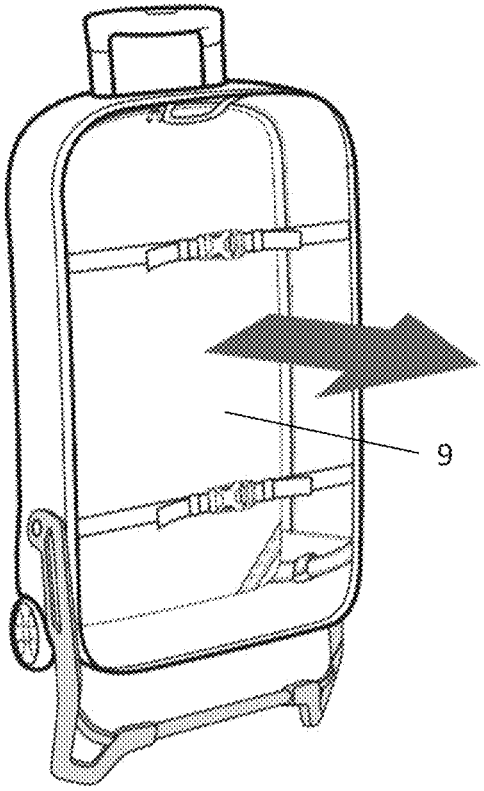
Figure 18D:
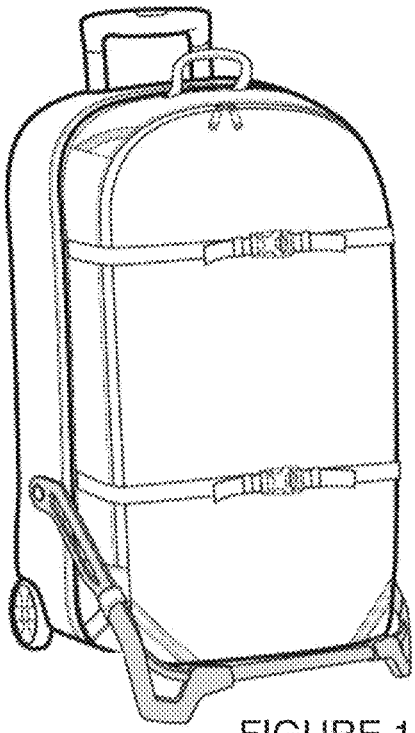
Figure 19:
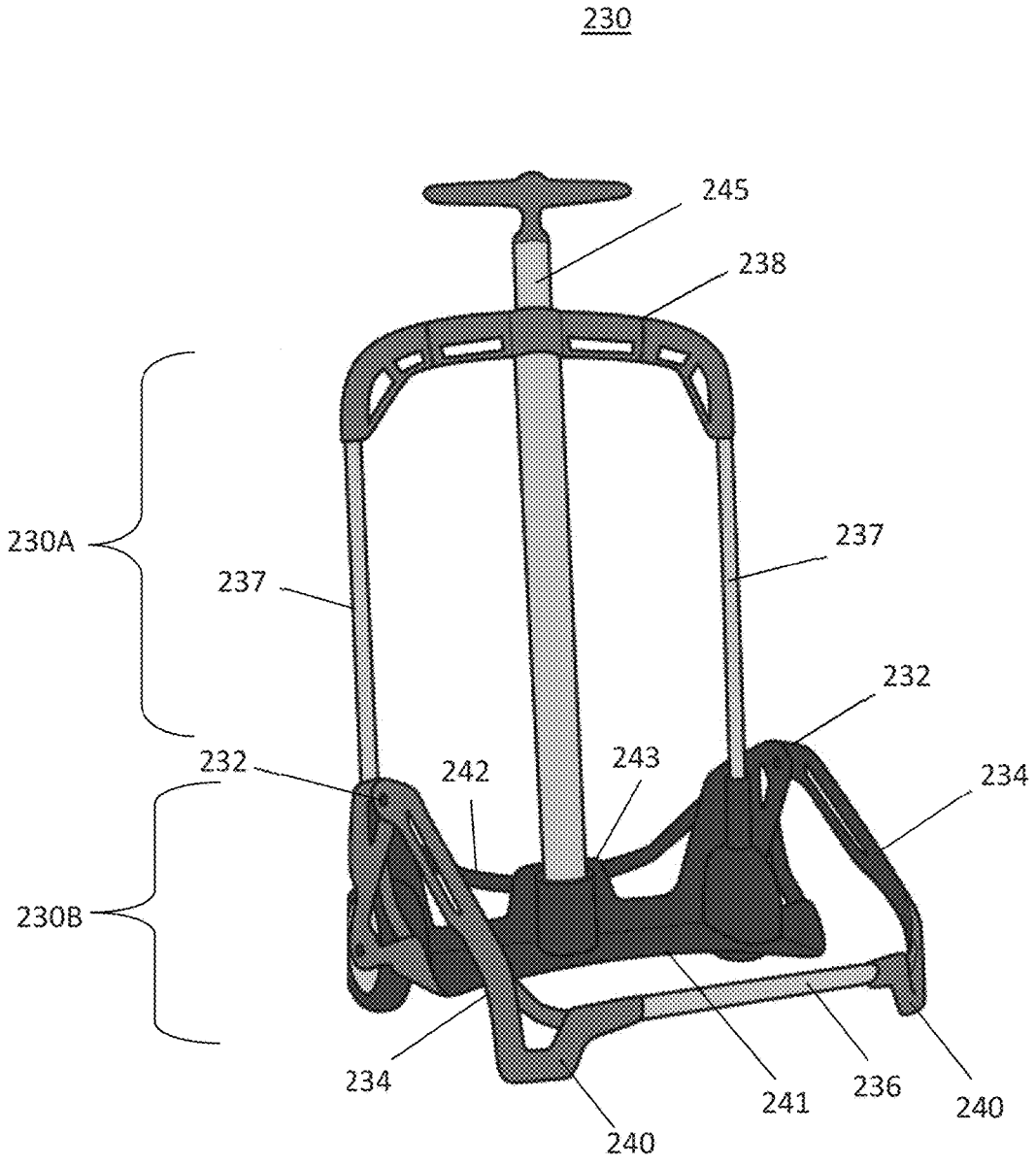
FIG. 19 shows a front left perspective view of a modular luggage frame for a luggage item.
Figure 20:
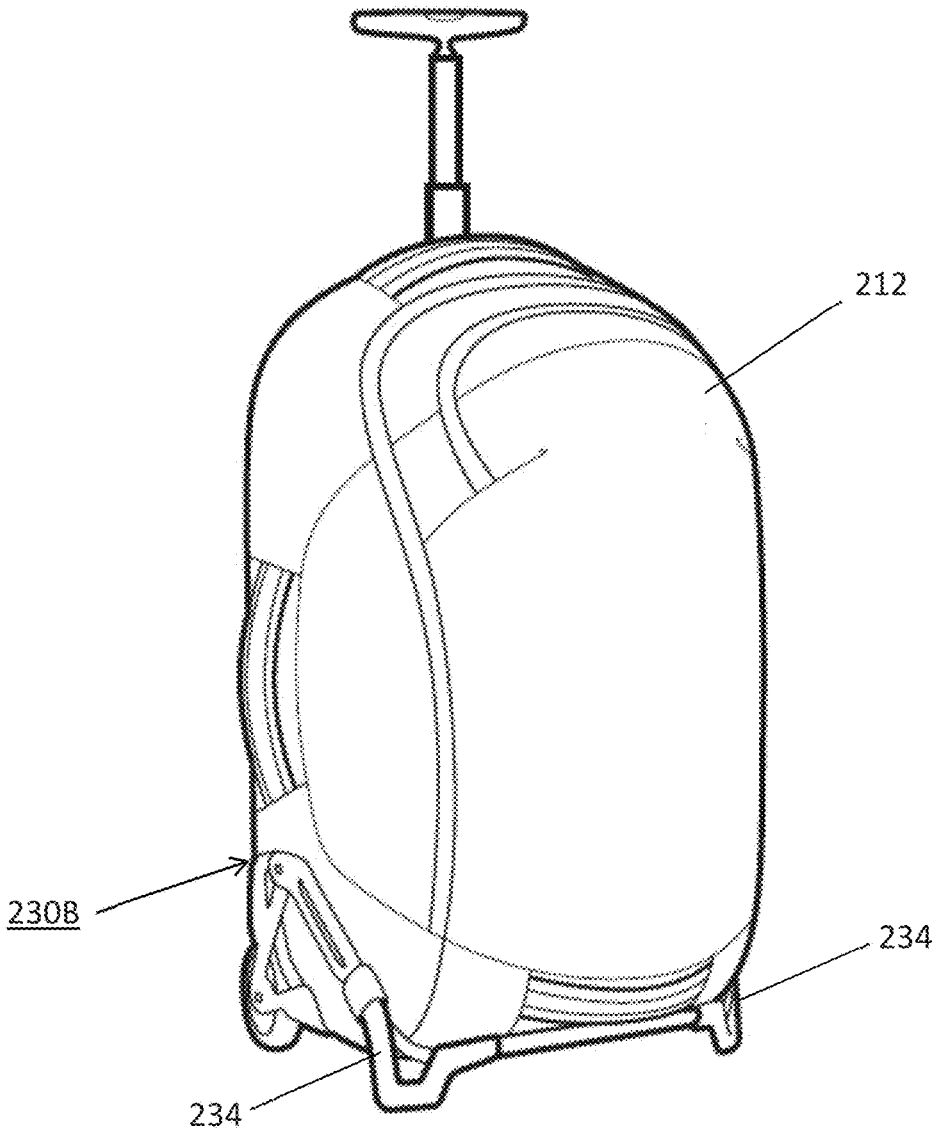
FIG. 20 shows a front left perspective view of the frame of FIG. 19 with an associated luggage item in place on the frame.
Figure 24A:
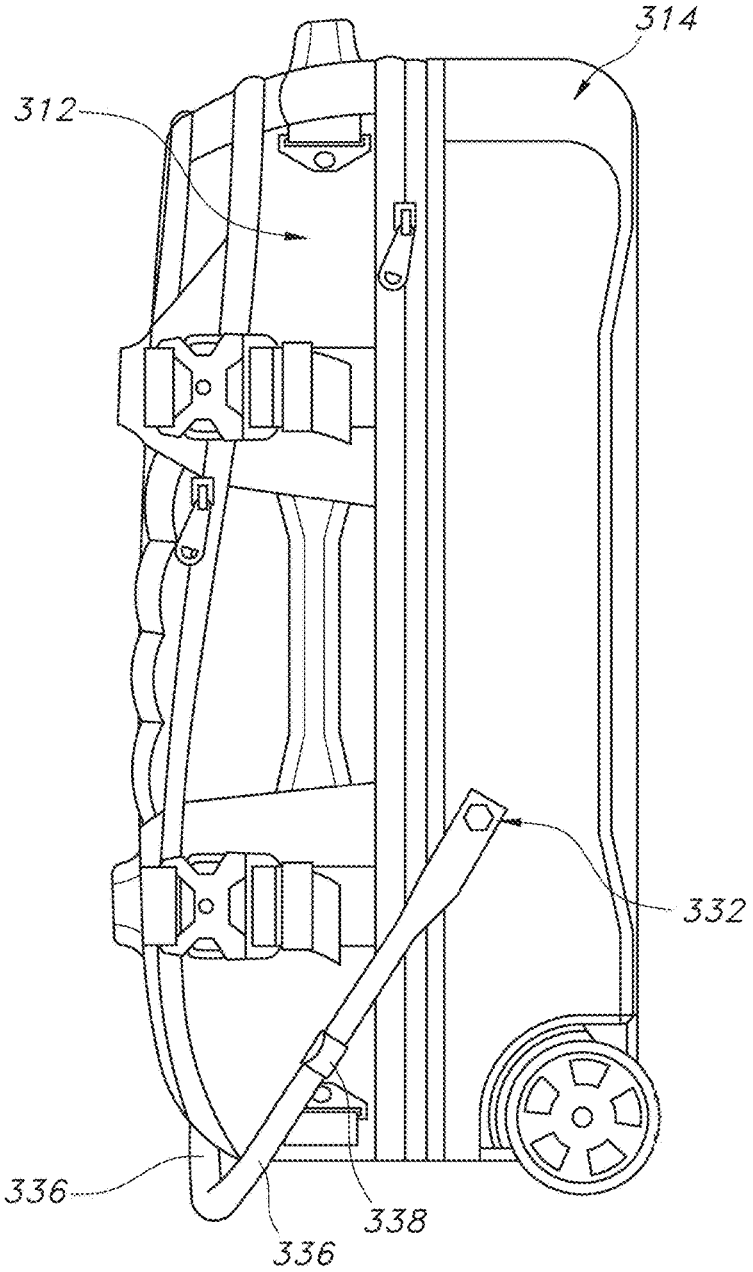
FIGS. 24A-D show another example of a modular luggage item used with an associated movable frame.
Figure 24B:
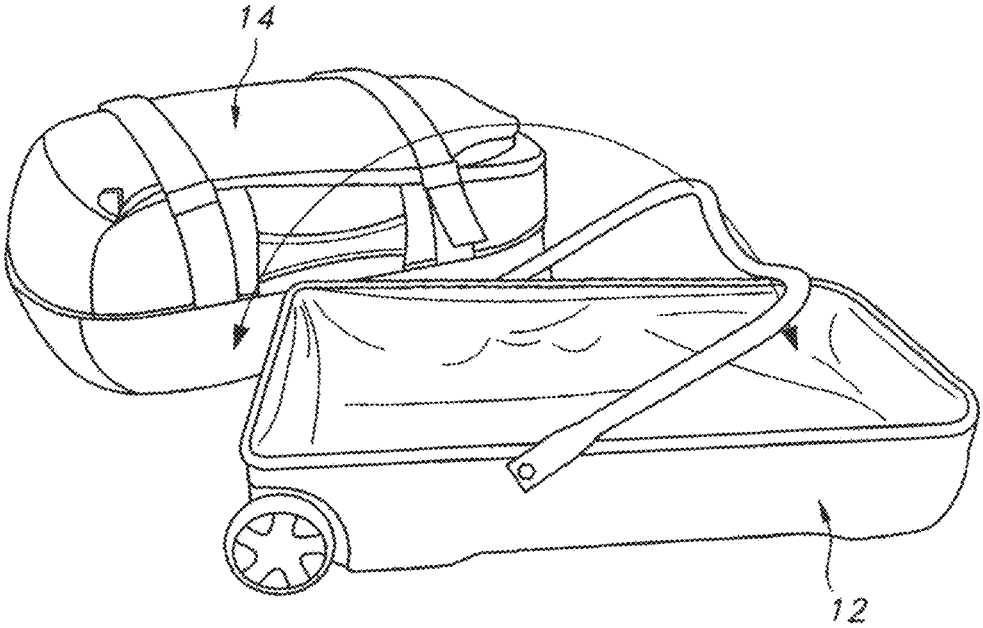
Figure 24C:
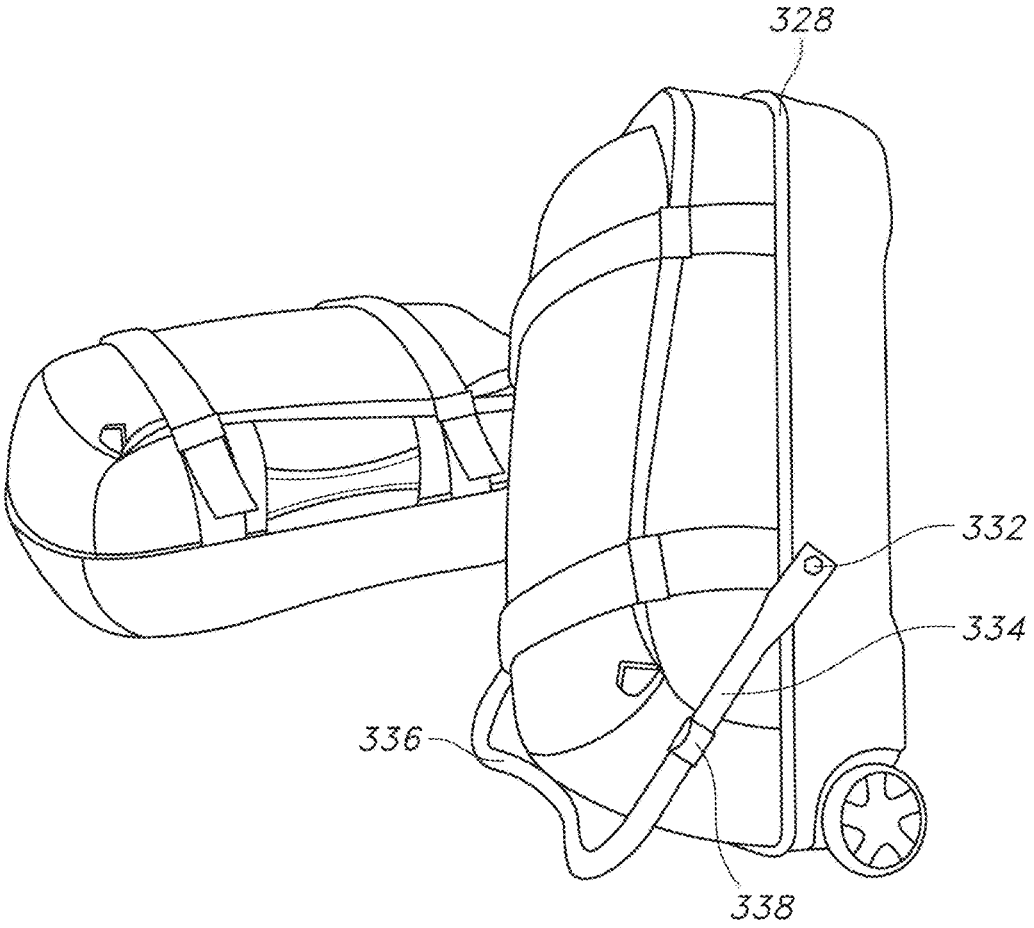
Figure 24D:
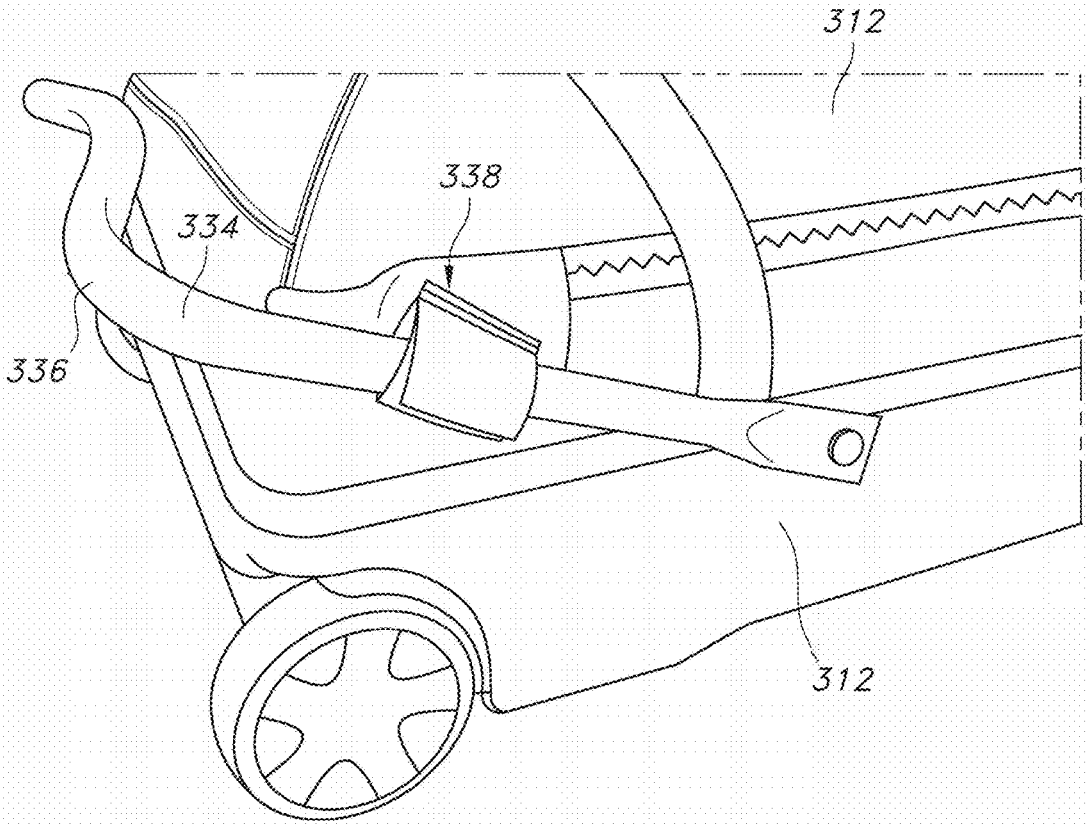

18A-D, FIGS. 24A-D.) The frame can move out of place to clear free of the removable item (FIG. 18C, FIG. 24B), allowing for its detachment and the expansion of the removable section, and then back into place, and attach to the expanded section to create a new piece of luggage that stands upright by support of the frame (FIG. 18D, FIG. 24D).

FIGS. 19-24D show embodiments where a luggage item, such as a duffel bag 212 or 312, is removably couplable to a frame 230 or 330. FIGS. 15A-15B show another example of a main item of luggage in the form of a duffel bag with a removable item attached at one end, namely a shoulder bag. Persons skilled in the art will recognize that frames according to the inventive subject matter may be adapted for use with such a duffel bag assembly.

Unlike the frame of the embodiments of FIGS. 16-21B, for example, the frames 230 and 330 of FIGS. 19-23 include not only a lower frame support structure similar to frame 30 but also an upper frame support portion 230A. The overall frame may be configured to receive and cradle or nest a luggage item 212, 312. The upper frame portion 230A, 330A includes structural elements sufficient to define a support for receiving and securing a luggage item. In the embodiment shown, the upper frame portion may be a unitary structure or an assembly of components. In the examples of FIGS. 19-23, the upper frame portion includes opposing vertical supports 237 and a telescoping handle assembly 245. An upper cross member 238, 338 intercouples the vertical supports at their upper ends. The lower ends of the vertical supports are coupled to the lower frame portion 330B. The couplings shown may be tubular interconnects, e.g., the end of one element plugs into the end of another and is secured by frictional engagement. Flanges or increasing taper may be provided near the end of the interconnecting portion of an element to limit travel of the received portion of the other element to provide a stop and help secure the interconnection. The telescoping handle assembly 345 may include transverse extensions 338A that form part of the cross member 338 and receive transversely disposed elements 338B, 338*b* extending from upper ends of the vertical supports, the ends also forming part of the cross member. The lower end of the shaft for the telescoping handle assembly is similarly received in a tube or socket 243, 343 integrated into the lower frame portion. The lower frame portion may include a front cross member 236, 336 and a rear cross member 241, 341. The front cross member is coupled to arms 234, 334. The rear cross member is coupled to the opposing wheel assemblies, which are also hingeably coupled to arms 334, in this embodiment. Structural struts 242, 342 may be used in the lower frame assembly to interconnect with other sections, such as the wheel assemblies, arms, or sockets that receive other elements, such as telescoping handle assembly 245, 345.

The arms and front cross member in the lower frame assembly may serve the same purposes as those described above for frame 30, namely those elements can move from a support position, for keeping a luggage item upright, to a cleared position that allows access to features on a luggage item secured in the overall frame (e.g., frame 230, 330) or that allows the secured item to be detached from the frame. The lower frame portion 230B, 330B may be configured to receive and support the weight of the luggage item. For example, one or both of the rear and front cross members, given their size and spacing, may be used to support the weight of the luggage item with a first side of an item, e.g., the bottom side, which has a size and shape so as to be in supporting engagement with one or both cross members. Similarly, the upper frame portion 230A, 330A can receive and support a luggage item on an orthogonal side relative to the first side of the item. In the embodiment shown, the upper and lower frame assemblies collectively define an area into which a luggage item of corresponding size and dimension can be received in a close-fitting, cradled manner.

A detachable luggage item may be removably coupled to a frame in various manners. For example, straps, hook and loop fasteners, snaps, sleeves, etc. could be used on portions of the item and frame to engage the item and frame together.

Modular Frame and Luggage Item Assembly

Figure 23:
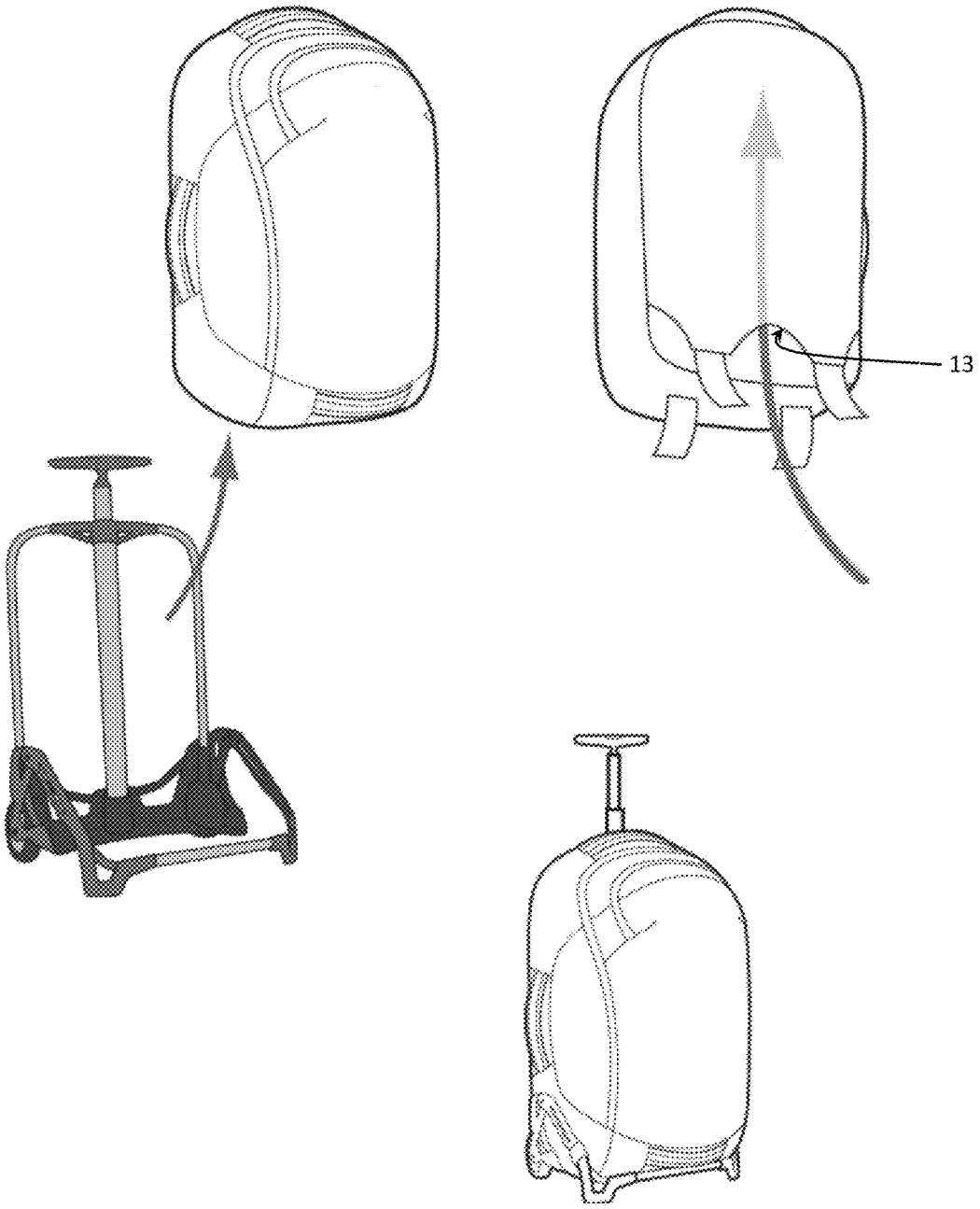
FIG. 23 shows a modular frame and a luggage item and the means for coupling the modular frame to the luggage item.

The components of the frames 230 and 330 may be permanently affixed to one another or detachable from one another in modular fashion. The embodiment of FIGS. 22A-22F show an example of a modular frame and luggage item assembly. The components of frame 330 are detachable from one another and from a luggage item 312. The components are sized so as to be compactly bundleable. For example, they can be stored in a stuff sack (FIG. 22A), box, etc. Frame components for frame 330 and a foldable luggage item 312, such as duffel bag, are seen bundled for storage in a stuff sack of corresponding size in FIG. 28B. FIGS. 22C-22F show further details of storage and assembly of the frame components and luggage item. FIG. 23 illustrates one way to attach the luggage item to the frame portion 230, 330. The luggage item includes a close-fitting sleeve 13 that fits over at least the upper frame portion 230A, 330A and retains the item on the frame. The lower frame portion could pivot or hinge out of the way so that the duffel bag can be unzipped from the front of the item.

In the embodiment of FIGS. 24A-24D , the frame has a simple unitary tubular construction. An expandable section, like expandable section 9, is included in the main compartment of the luggage item. It can be deployed after removing a detachable luggage item from the main item, as in other embodiments described herein.

Figures 25A, 25B:
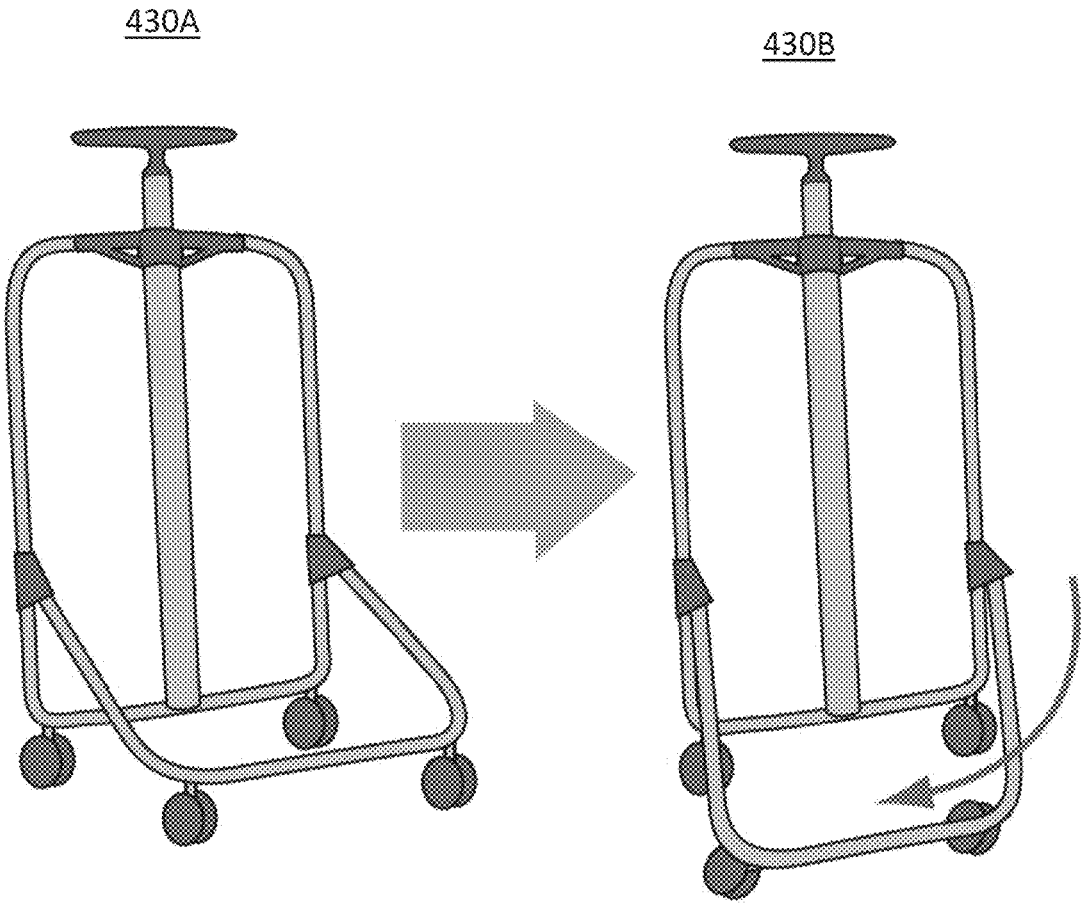
FIGS. 25A-C show another example of a movable frame in first and second positions of deployment.
Figure 25C:
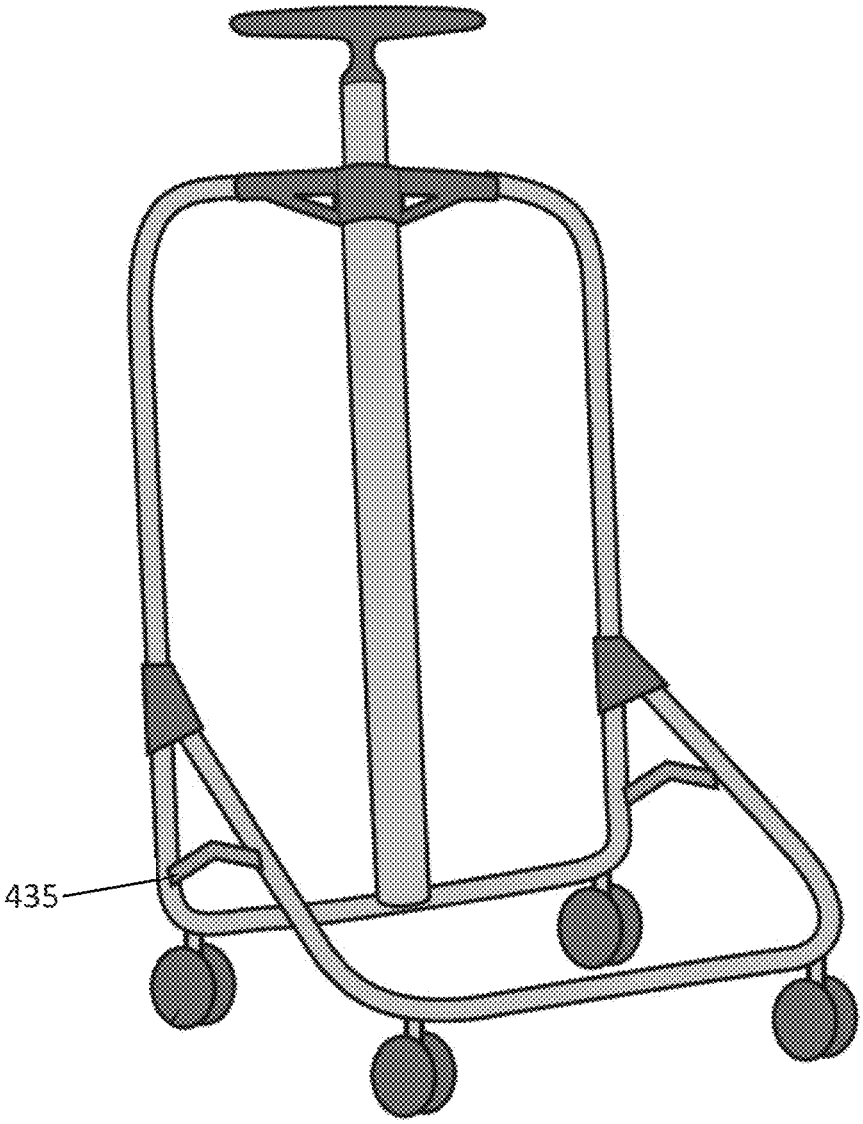

FIGS. 25A and 25B show a frame 430 that includes four wheel assemblies coupled to a lower frame portion. The wheels may be of any type. The ones shown are caster style wheels, and they may be removable from the frame. FIG. 25C shows that the arms in the lower frame assembly may each have a pivot point on the vertical supports. A foldable lock hinge or strut 435 is also disposed below the pivot points and interconnects the arms and supports. When in the locked position, the foldable lock hinge serves as a strut between the supports and the arms, fixing locking them into position. Another possibility is for a strut to be non-folding but instead slidably coupled to an arm or vertical support to fix the arm and support in and out of locked position, such as are used in folding brackets.

As used herein "adjacent" means directly adjacent or indirectly adjacent, i.e., there may be close spacing but separation by an intermediate layer of material or structure. As used herein, "couple" and variants of that word mean directly or indirectly connected or attached together.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature that may be cited herein is hereby incorporated by references in its entirety for all purposes.

The invention claimed is:

1. An item of luggage, comprising:

a plurality of sides sufficient to define a first volumetric space, a pivotable frame coupled to the item at opposing pivot points on the item, the frame comprising a pair of arms, each arm pivotably coupled to the item at a pivot point and extending therefrom; and a cross member disposed between and coupled to the arms, the arms pivotably moving the cross member from a first position to a second position, the cross member being movable so that it may be disposed along an edge of a front side of the item, the pivot points being spaced rearward of the front side on different opposing first and second sides;

wherein the frame is configured as a cradle such that when the cross member is in the first position, the cross member and the arms are closely adjacent the lateral sides of the luggage item, and the cross member is closely adjacent a lower front edge of the luggage item;

wherein when the cross member is in the first position it is capable of engaging the ground and supporting the item in an upright position, at least a portion of the cradle being disposed across at least a portion of an exterior surface of the item; and wherein when the cross member is moved to the second position, the portion of the cradle disposed across the exterior surface of the luggage item clears the cradle away from that surface so that the surface is unimpeded by the portion of the cradle.

2. The item of claim 1 wherein the pivot points are disposed on the lateral side walls at positions that are closer to a back side of the item than the front side.

3. The item of claim 2 wherein the pivot points are disposed on the side walls at a position on the side walls that is closer to a bottom side of the item than a top side of the item.

4. The item of claim 1 wherein the pivots points are associated with wheels mounted on wheel axles disposed at opposite sides at about a bottom side of the luggage item.

5. The item of any of claim 1 wherein the arms and/or cross member of the frame are capable of engaging the ground and supporting the item in an upright position when the cross member is in the first position.

6. The item of claim 1 wherein the portion of the cradle is disposed across an openable surface for a compartment of the item.

7. The item of claim 1 wherein when in a first position the cross member is disposed adjacent the front lower edge of the luggage item and is movable to a second position spaced below the lower edge.

8. The item of claim 1 wherein each arm comprises an assembly of components that are coupled by a mechanism that allows collapsibility of the arm.

9. The item of claim 8 wherein the mechanism comprises a hinge enabling the arms to collapse by folding together.

10. The item of claim 1 further comprising an expandable section that is disposed within the space between first and second opposing sides, wherein at least the first opposing side defines a boundary for the volumetric space and provides an exterior surface for the item of luggage; and the expandable section has a first configuration wherein it is stored within the space and has an expandable side that is adjacent to the first opposing side, and a second configuration wherein the expandable side extends a predetermined distance from the first opposing side to define a boundary for a second volumetric space that is the same as or different from the first volumetric space.

11. An item of luggage, comprising:

a plurality of sides comprising a front side, an opposing back side and opposing left and right sides disposed between the front and back sides, the sides defining a first volumetric space, a frame coupled to the left and right sides of the item, the frame being moveable from a first position that supports or reinforces the item along a bottom edge of the front side to a second position that is rearward of the front side and toward the back side, the second position clearing the frame from a surface of the item allowing access to compartments or features on the item accessed at the front side of the item; and wherein a closure mechanism for accessing a compartment in the item, is associated with the portion of the exterior surface of the item, and the movement of a cross member that is included in the frame from the first position, where it impedes the use of the closure mechanism, to the second position, clears the cross member from the closure mechanism to provide unimpeded use of the closure mechanism.

12. The item of claim 11 wherein the frame further comprises one or more feet disposed on the frame, the feet being configured to engage a ground surface supporting the item when the item is in anh upright position with the frame in the first position.

13. The item of claim 11 wherein one or more wheels are disposed on the frame to facilitate rolling of the item.

14. The item of claim 13 wherein the one or more wheels are disposed on the arms or cross member and are configured on the item to facilitate rolling of the item.

15. A frame for a luggage item, comprising:

an upper frame portion and a lower frame portion, the portions being arranged orthogonal to one another so as to be configured to receive orthogonal side portions of a luggage item, the upper portion comprising an assembly of elements and the lower frame portion comprising an assembly of elements, the upper and lower frame portions being detachable from one another to enable storage of the frame portions in a more compact form than when assembled together, and wherein the frame includes a set of opposing arms that at one set of ends are coupled to a cross-member for engaging a ground surface supporting the item in an upright position when the cross member is in a first position, and another set of ends for the arms are each hingeably coupled to a wheel assembly, the arms hinging from the first position to a second position that clears the frame from impeding access to a predetermined surface on a luggage item coupled to the frame.

16. The frame of claim 15 wherein the upright portion and/or lower portion are formed of a set of detachable elements that enable storage of the upright and/or lower frame portions in a more compact form than when assembled together.

* * * * *